United States Patent [19]

Klayman

[11] Patent Number: 4,866,774

[45] Date of Patent: Sep. 12, 1989

[54] STERO ENHANCEMENT AND DIRECTIVITY SERVO

[75] Inventor: Arnold I. Klayman, Huntington Beach, Calif.

[73] Assignee: Hughes Aircraft Company, Los Angeles, Calif.

[21] Appl. No.: 266,467

[22] Filed: Nov. 2, 1988

[51] Int. Cl.[4] ..... H04S 1/00

[52] U.S. Cl. ..... 381/1

[58] Field of Search ..... 381/1, 27, 17, 18

[56] References Cited

U.S. PATENT DOCUMENTS 4,748,669 5/1988 Klayman ..... 381/1

*Primary Examiner*—Forester W. Isen

*Attorney, Agent, or Firm*—Joseph E. Szabo

[57] ABSTRACT

In a stereo system having sum and difference signals that are processed for stereo image enhancement, apparent directivity of the stereo sound is increased by the use of servo systems (40,44) for the left and right processed difference signals $(L-R)_p$, $(R-L)_p$. Each of the left and right servos (40,44) responds to the respective left or right stereo input signal ($L_{in}$, $R_{in}$) and amplifies increases in the respective left or right processed difference signals. The amount of amplification is controlled by feeding back the amplified or directivity enhanced difference signal $(L-R)_{pe}$, $(R-L)_{pe}$, first comparing it with the processed difference signal $(L-R)_p$, $(R-L)_p$ before directivity enhancement, and then combining it with the input signal ($L_{in}$, $R_{in}$) in a preselected ratio so as to control the amount of amplification of the processed difference signal that is provided for directivity enhancement.

72 Claims, 9 Drawing Sheets

VOLTAGE CONTROLLED AMPLIFIER
DIFFERENCE
VOLTAGE CONTROLLED AMPLIFIER
DIFFERENCE
PEAK DETECTOR
PEAK DETECTOR
PEAK DETECTOR
PEAK DETECTOR
(L-R)PE
(R-L)PE
(L-R)PE-(L-R)P
(R-L)PE-(R-L)P
(L-R)P
LIN
RIN
46
48
80
82
86
180
182
186
60
72
160
172
62
64
66
68
70
71
162
164
166
168
170
171
42
230
230

STERO ENHANCEMENT AND DIRECTIVITY SERVO

This application is related to my prior U.S. Pat. No. 4,748,669, issued May 31, 1988 for Stereo Enhancement System. The disclosure of this prior patent is incorporated by this reference as though fully set forth herein.

BACKGROUND OF THE INVENTION

1. Field of the Invention

The present invention relates to stereo sound image enhancement, and more particularly concerns methods and apparatus for enhancing directivity of left and right channel sounds produced by a stereo speaker system.

2. Description of Related Art

In my prior U.S. Pat. No. 4,748,669 for Stereo Enhancement System, there is described a stereo sound image enhancement system in which sum and difference signals are processed so as to boost certain frequency components of the difference signal and to relatively attenuate certain frequency components of the sum signal. In addition, amplitude of the processed difference signal is servo controlled so as to maintain a relatively constant amount of stereo sound from one record to another or from one time to another within a given record.

Certain applications of the enhancement system and method of my prior patent, and many other stereo sound systems also, can benefit considerably from increased directivity of the stereo sound image. By increased directivity is meant such selective enhancement of sound from one side or the other of the apparent stereo sound image that exaggerates or amplifies sound that appears to emanate from one side or the other of the stereo sound image or from an area displaced from the center of the image. For example, where different sound elements of a source, such as particular instruments, are positioned at fixed locations to one side or the other of the center stage, it is desirable, in reproduction of such sound source, to emphasize or enhance the fact that such individual instrument is at its particular location, a location that is displaced from the center of the audio image. Moreover, it is desired to expand the apparent width of the entire sound image to provide an enhanced stereo sound. With such an arrangement of enhanced directivity, not only is apparent lateral displacement of individual instruments and other fixed sound sources enhanced, but the subjective effect of motion created by sound of an object moving from right to left or left to right across the sound field of the listener is also greatly increased. For example, when watching a highspeed automobile or airplane moving across a television or movie screen from right to left, the viewer not only sees the vehicle crossing the screen, but also hears the sound of the vehicle approaching the right side of the screen before the visual image appears on the screen. Sound from the left is of lower intensity at this time. So too, as the vehicle moves to the left edge of the screen and beyond view, sound from the left side of the stereo sound image increases, and sound from the right side decreases. Initially, with a vehicle moving from right to left, the vehicle sound appears to come solely from the right. As the vehicle exits at the left side of the screen, vehicle sound appears to come only from the left. By suitably and controllably magnifying the sound primarily appearing to come from the right side and sound primarily appearing to come from left side of the stereo sound image, the total subjective effect of the combined visual and audible motion from right to left is greatly enhanced. In other words, directivity of the sound image is increased. Even in the absence of any visual image, apparent motion of the audio image is more realistic with enhancement of directivity. No such directivity enhancement, whether for moving sound images or for laterally displaced fixed sound source components, is available in any prior art insofar as applicant is aware.

Accordingly, it is an object of the present invention to provide directivity enhancement for a stereo sound image.

SUMMARY OF THE INVENTION

In carrying out principles of the present invention, in accordance with a preferred embodiment thereof, a directivity servo is provided for controllably amplifying a stereo difference signal in response to amplitude of an input signal from one side or the other or from one channel or the other. More specifically, there is provided an amplitude control circuit having a stere difference signal as and input and providing a directivity enhanced signal as its output. The amplitude control circuit is controlled by a servo control signal which is responsive to the directivity enhanced difference signal and to one of the stereo input signals. The control signal is provided by generating a feedback signal indicative of the directivity enhanced signal and combining it with the stereo input signal.

In accordance with another feature of the invention, the directivity enhanced difference signal is compared with the difference signal prior to its directivity enhancement to provide a feedback signal that is combined with a stereo input signal in a selected ratio. The combined signal is integrated to provide the control signal to the amplifier.

DESCRIPTION OF THE PREFERRED EMBODIMENTS

Figure 1:
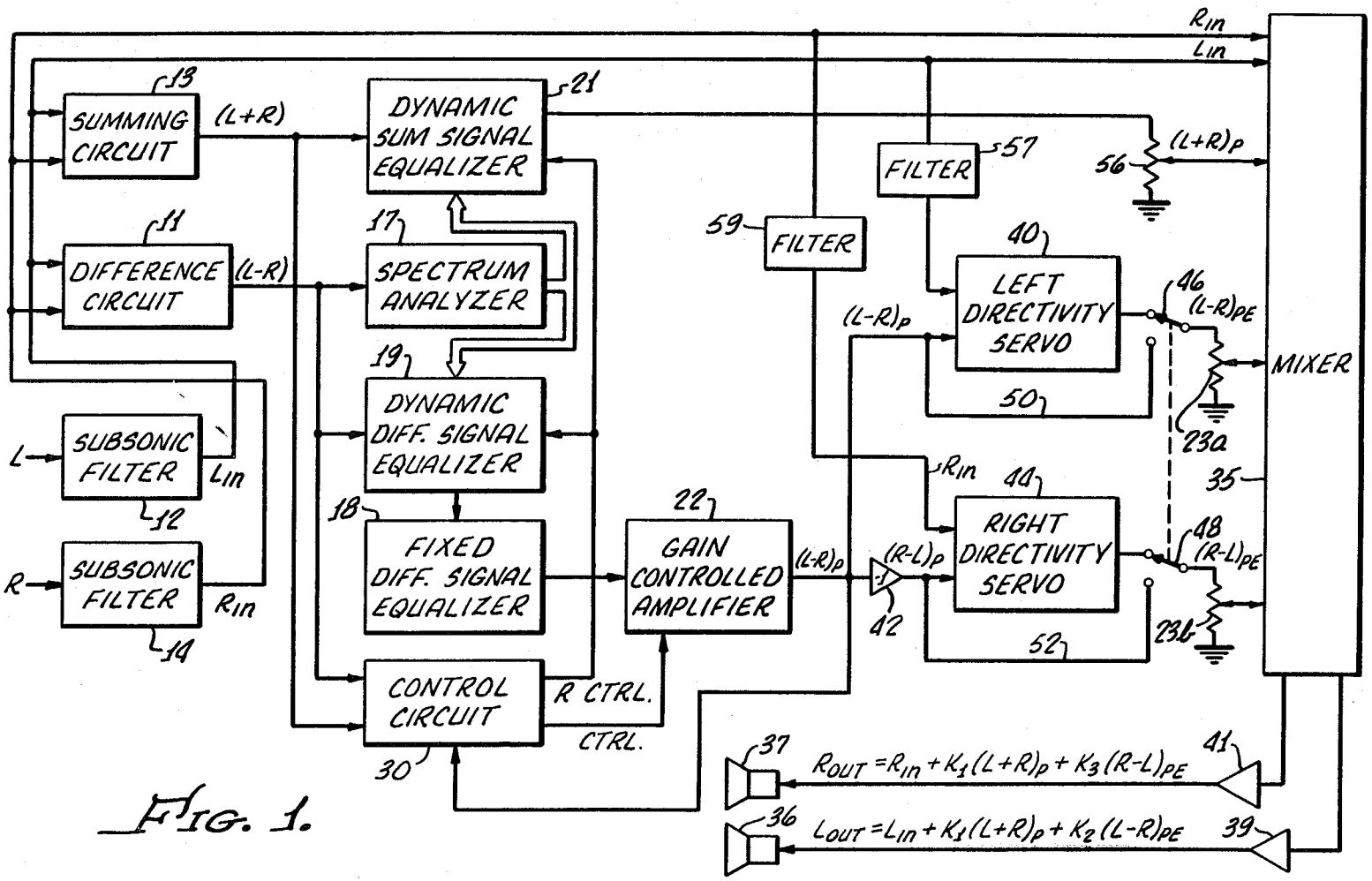
FIG. 1 is a block diagram showing a stereo image enhancement system employing directivity servos in accordance with the present invention.

The system illustrated in FIG. 1 is basically the same as that shown in my prior patent identified above. However, FIG. 1 shows the circuit of the prior patent modified to incorporate directivity servos of the present invention.

Left channel and right channel stereo input signals L and R are fed through subsonic filters 12 and 14 to provide stereo input signals $L_{in}$ and $R_{in}$. The input stereo signals are fed to a difference circuit 11 and a summing circuit 13 to provide difference and sum signals (L−R) and (L+R).

It will be understood that the stereo input signals $L_{in}$, $R_{in}$ (in all embodiments described herein) may be provided either directly from a stereo source, or indirectly from conventionally broadcast sum and difference signals. In the latter case the received sum and difference are processed as described above, and the signals $L_{in}$, $R_{in}$ are obtained by additively and subtractively combining the sum and difference signals. The difference signal is fed to a spectrum analyzer 17 which provides a plurality of output signals representing relative amplitudes of different components of the difference signals in a group of preselected frequency bands. The spectrum analyzer output signals are fed to a dynamic difference signal equalizer 19 which boosts amplitude of components of the difference signal in those frequency bands where the difference signal amplitude is less. In other words, components of the difference signal in those frequency bands which are normally quieter are boosted by the equalizer 19.

The output of the spectrum analyzer is also fed to a dynamic sum equalizer 21 which relatively boosts components of the sum signal in those frequency bands outside of those bands where the difference signal is quieter. The output of the dynamic difference signal equalizer 19 is also fed for further equalization to a fixed difference signal equalizer 18.

A servo loop for the processed difference signal, which has been processed by the equalizers 18 and 19, is provided via a gain controlled amplifier 22 and a control circuit 30. This servo loop, like the several equalizers, is described in detail in my above identified prior patent. Control circuit 30, responsive to the unprocessed sum and difference signals (L+R) and (L−R) and to the output of amplifier 22, namely the processed difference signal $(L-R)_p$, produces a control signal (CTRL) that controls gain of the amplifier. The arrangement is such as to maintain a predetermined, substantially constant, ratio between the processed difference signal and the unprocessed sum signal.

The system of my prior patent also includes reverberation control by circuitry in control circuit 30 which produces a reverberation control signal (RCTRL) which is fed to both of the dynamic signal equalizers 19 and 21. Input signals $L_{in}$ and $R_{in}$, and the processed sum signal $(L+R)_p$ are fed to a mixer 35. In my prior patent the processed difference signal $(L-R)_p$ from the gain controlled amplifier is also fed to the mixer. In the prior patent the processed sum and difference signals are fed through adjustment potentiometers for adjustment of certain effects of the system. In the prior patent the mixer operates on the several inputs thereto to provide left and right output signals. as defined by the following equations:

$$L_{out}=L_{in}+K_1(L-R)_p+K_2(L+R)_p \quad \text{Eq. (1)}$$

$$R_{out}=R_{in}+K_2(L+R)_{p-K3}(L-R)_p \quad \text{Eq. (2)}$$

Where $K_1$, $K_2$ and $K_3$ are constants. In these equations the quantity $-K_3(L-R)_p$ is the same as $+K_3(R-L)_p$, and, in my prior patent, an inverter is provided in the mixer to invert the processed difference signal $(L-R)_p$ to provide the processed difference signal $(R-L)_p$. In the system of my prior patent, the processed difference signal $(L-R)_p$ is thus part of the signal provided by the mixer to the left speaker 36, and the processed difference signal $(R-L)_p$ is part of the signal provided by the mixer to the right speaker 37. The signals from mixer 35 are fed to the speakers via driver amplifiers 39,41. Note that FIG. 1 shows the speakers 36,37 receiving outputs of the modified mixer having directivity enhanced outputs. The mixer outputs of my prior patent are defined by equations (1) and (2), but are not shown in the drawings.

In accordance with a feature of the present invention, the mixer is changed to remove the inverter from the mixer and to place it between the output of the gain controlled amplifier 22 and one of the directivity servos which are added to the system of my prior patent. This arrangement is illustrated in FIG. 1, which shows the added left and right directivity servos 40,44 interposed between the output of gain controlled amplifier 22 and the mixer 35. Except for the change in location of the inverter and the addition of the directivity servos, the system of the present invention is the same as that described in my prior patent.

As shown in FIG. 1, the processed difference signal $(L-R)_p$ from gain controlled amplifier 22 is fed as one input to a left directivity servo 40, and also fed to an inverter 42 which provides the right processed difference signal $(R-L)_p$. The right processed difference signal $(R-L)_p$ is fed as one of the inputs to a right directivity servo 44. The right and left servos 40 and 44 receive as second inputs thereto the left stereo input signal $L_{in}$, and the right stereo input signal $R_{in}$ respectively. The servos provide, at their outputs, the directivity enhanced left difference signal $(L-R)_{pe}$ and the directivity enhanced right difference signal $(R-L)_{pe}$. The signals are provided via a pair of ganged two position switches 46,48 which connect alternatively to the directivity servo outputs or to bypass lines 50,52. The bypass lines are connected directly to the processed difference signal inputs $(L-R)_p$ and $(R-L)_p$ so that the directivity servos may be disabled or bypassed simply by moving the ganged switches to the second or non-illustrated positions.

Because low frequency signals have large energy content, it is found desirable to avoid adverse effects that might be caused by sharp bass transients in the right and left input signals $R_{in}$ and $L_{in}$. Accordingly, the right and left input signals are filtered via filters 57 and 59 (FIG. 1) before being fed to the directivity servos 40 and 44 respectively. These filters are relatively flat above 150 Hz and have a sharp roll off at 150 Hz and below, rolling off at approximately 12 dB per octave. Effectively these are high frequency pass filters having a fairly sharp cutoff at or about 150 Hz.

Directivity enhanced left and right difference signals $(L-R)_{pe}$ and $(R-L)_{pe}$ are fed to the mixer 35, together with the stereo input signals $R_{in}$ and $L_{in}$ and the processed sum signal $(L+R)_p$. The latter is amplitude adjusted by means of a potentiometer 56. The directivity enhanced left and right difference signals are fed to the mixer via ganged amplitude adjusting potentiometers 23a and 23b, which are adjustable together to concurrently adjust the amount of left and right stereo difference signals going to the mixer. Effectively, adjustment of the potentiometers 23a and 23b will adjust the apparent width of the stereo image provided by the mixer output signal.

With the described input to mixer 35, the mixer provides to speaker system 36,37, the outputs $L_{out}$ and $R_{out}$ in accordance with the following equations:

$$L_{out}=L_{in}+K_1(L+R)_p+K_2(L-R)_{pe} \quad \text{Eq. (3)}$$

$$R_{out}=R_{in}+K_1(L+R)_p+K_3(R-L)_{pe} \quad \text{Eq. (4)}$$

Where $K_1$, $K_2$ and $K_3$ are constants. Note that in this system the left difference signal $(L-R)_p$ is inverted prior to being fed through the right directivity servo 44 to the mixer, whereas in the prior patent inversion of $(L-R)_p$ takes place in the mixer, which therefore provides the signal $(R-L)_p$.

Figure 2:
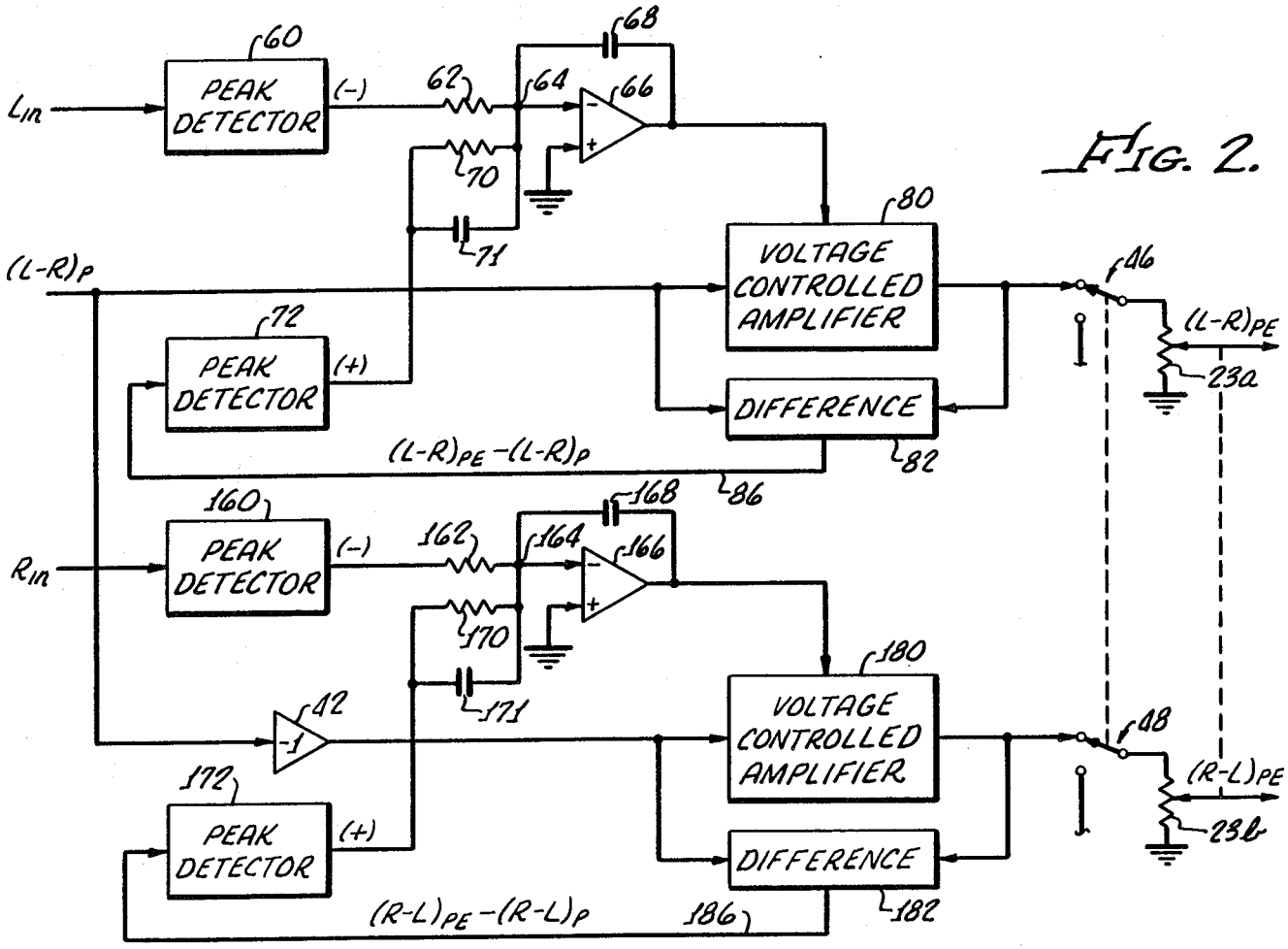
FIG. 2 shows further details of the directivity servos of FIG. 1.

Details of each of the left and right directivity servos are illustrated in FIG. 2. The two servos are substantially identical to each other, except that one operates on the left channel signals and the other on right channel signals, and thus a description of one channel will suffice to describe both.

Each directivity servo operates to provide an augmented amount of increase in the processed difference signal $(L-R)_p$ or $(R-L)_p$ upon increase of the respective input signals $L_{in}$ and $R_{in}$.

With reference to the left channel servo shown in FIG. 2, the input signal $L_{in}$ is fed to an input peak detector 60, which provides a negative going output signal in response to an increase of $L_{in}$. Conversely, it provides a positive going signal in response to a decrease in $L_{in}$. The output of the peak detector is the inverted amplitude envelope of the input signal. The peak detected input signal is fed through an input resistor 62 to a summing point 64 at the inverting input of an operational amplifier 66. A capacitor 68 is connected between the amplifier output and its inverting input so as to cause the amplifier to operate as an integrator. The inverting input of the amplifier, at summing point 64, has a second input from a parallel RC circuit of a feedback resistor 70 and a capacitor 71 which receives from a feedback peak detector 72 a signal of polarity opposite the polarity provided from the input peak detector 60. The output of peak detector 72 is the amplitude envelope of its input. The output of amplifier 66 is fed to a voltage controlled amplifier 80 which receives as its input the signal $(L-R)_p$, the processed difference signal from gain controlled amplifier 22 (FIG. 1). The voltage controlled amplifier 80 provides as its output the directivity enhanced difference signal output $(L-R)_{pe}$.

A difference feedback circuit 82 receives, as a first input, the processed difference signal $(L-R)_p$ from gain controlled amplifier 22 and, as a second input, the directivity enhanced left difference signal $(L-R)_{pe}$ from the output of amplifier 80. Difference feedback circuit 82 provides a feedback signal on line 86, having a magnitude proportional to the directivity enhanced difference signal $(L-R)_{pe}$ minus the processed difference signal $(L-R)_p$. This feedback signal is provided as the input to the feedback peak detector 72. The peak detected (amplitude envelope) feedback signal is fed to the inverting input of amplifier 66 via feedback resistor 70.

Feedback resistor 70 has a value in the order of two to three times the value of input resistor 62. The ratio of resistor 70 to resistor 62 determines the amount of directivity enhancement provided by the directivity servo. Preferably this ratio is between about two to one and three to one. If the ratio is substantially less than two to one, effects of the directivity servo are so small as to be of little value, whereas if the ratio is much greater than three to one, artificiality of the directivity effect becomes too apparent. One or both of resistors 62,70 may be made variable to enable a limited amount of adjustment of the amount of directivity enhancement.

In operation of the left directivity servo, assume that the input signal $L_{in}$ increases, and therefore, that the output of peak detector 60 decreases. A decreased signal is provided at the summing point 64, the inverting input of the amplifier, to cause the output of the amplifier to tend to increase in a manner tending to hold the total input (voltage) at point 64 substantially equal to the total input (voltage) at the grounded non-inverting input of the amplifier. As the output of the amplifier increases, integrating capacitor 68 of the amplifier charges, and the control voltage to the voltage controlled amplifier 80 also increases. The gain of amplifier 80 is unity in the absence of a control signal input from amplifier 66. This gain never falls below unity, but will increase as the control signal from amplifier 66 increases. As gain of the amplifier 80 increases, there is a concomitant increase in the directivity enhanced left difference signal output $(L-R)_{pe}$. The increased output of the voltage controlled amplifier is diminished by the processed difference signal $(L-R)_p$ in the difference circuit 82 to provide the feedback signal to the feedback peak detector 72. Thus the latter provides an increased signal of polarity opposite the polarity of the signal from the peak detector 60 to the inverting input of the amplifier 66.

The two voltages from the respective peak detectors are combined in the resistive summing network formed by resistors 62,70 to provide a combined signal which tends, by the amplifier feedback through capacitor 68, to stabilize at a value equal to the grounded input to the non-inverting input of the amplifier. Assuming a three to one ratio of resistance of resistor 70 to that of resistor 62, the amplifier input signal at summing point 64 stabilizes when the voltage of the peak detected feedback signal from feedback peak detector 72 is approximately three times the voltage of the signal from the input peak detector 60. By this arrangement, a controlled amount of feedback is provided to cause a controlled amount of increase of the integrating amplifier output. This increase of output of amplifier 66 causes a controlled amount of increase of the control voltage that is fed to the voltage controlled amplifier 80.

It is desired to cause the voltage controlled amplifier 80 to respond only to changes in the reference signal, which is the output of peak detector 60. The output of the voltage controlled amplifier, which has a gain that never drops below unity, is never less than the input $(L-R)_p$. Thus the feedback signal from difference circuit 82 causes the directivity servo to respond only to changes in the reference. If there is no change in the reference (output of peak detector 60), there is no control signal to amplifier 80, and its output is the same as its input, whereby there is no feedback signal provided to peak detector 72. Use of the difference circuit 82 allows a closer control of the amount of change in $(L-R)_p$ (e.g. the difference between the output and input of the voltage controlled amplifier) with respect to a change in the input reference signal $L_{in}$.

The result is that an increase in the input signal $L_{in}$ yields an enhanced (exaggerated) increase in the processed difference signal to produce the directivity enhanced difference signal $(L-R)_{pe}$ at the output of the voltage controlled amplifier. With the value of resistor 70 selected to be two to three times the value of resistor 62, the increase in amplitude of the processed difference signal is two to three times the increase in amplitude of the input signal. A decrease in amplitude of $L_{in}$ does not yield any enhanced decrease of $(L-R)_{pe}$, because gain of amplifier 80 is never less than unity. As previously described, the directivity enhanced left difference signal is fed to the mixer via the bypass switch 46 and stereo image width adjustment potentiometer 23*a*.

Capacitor 71, connected across feedback resistor 70, provides increased rate of feedback for fast moving phenomena. For relatively slow changes of the output of peak detector 60, capacitor 71 is effectively inoperative. However, for rapid changes of such output, the feedback from peak detector 72 is transmitted rapidly through the capacitor 71 to enhance response time of the feedback.

Operation of the right directivity servo is the same as described above, but, of course, this servo operates in response to $R_{in}$ and $(R-L)_p$ (received from inverter 42) to provide the directivity enhanced right difference signal $(R-L)_{pe}$, which is fed to the mixer via bypass switch 48 and stereo image width adjustment potentiometer 23*b*.

The right servo includes the same components as the left servo and these are identified by the same reference numerals, having a prefix 1 so that left channel enhanced peak detector 60 corresponds to right channel peak detector 160, left channel amplifier 66 corresponds to right channel amplifier 166, etc.. Thus the right channel directivity servo includes peak detectors 160 and 172, summing resistors 162,170, capacitor 171, summing point 164, integrating amplifier 166, feedback capacitor 168, voltage controlled amplifier 180, difference circuit 182, and feedback line 186, all identical to the correspondingly numbered components of the described left channel.

Capacitors 71 and 171 of FIG. 2 act in conjunction with feedback capacitors 68 and 168 across the differential amplifiers 66,166, respectively, to maintain the desired ratio of the signals fed from the two peak detectors 60,72 and 160,172 of the respective channels. Capacitor 71 is approximately four times greater than the capacitor 68—one being about 16 microfarads, and the other being about 4.7 microfarads. The ratio of impedances of capacitors 168,171 is the same. Thus, even for high speed variations of the sound, the desired directivity enhancement is achieved.

Figure 3:
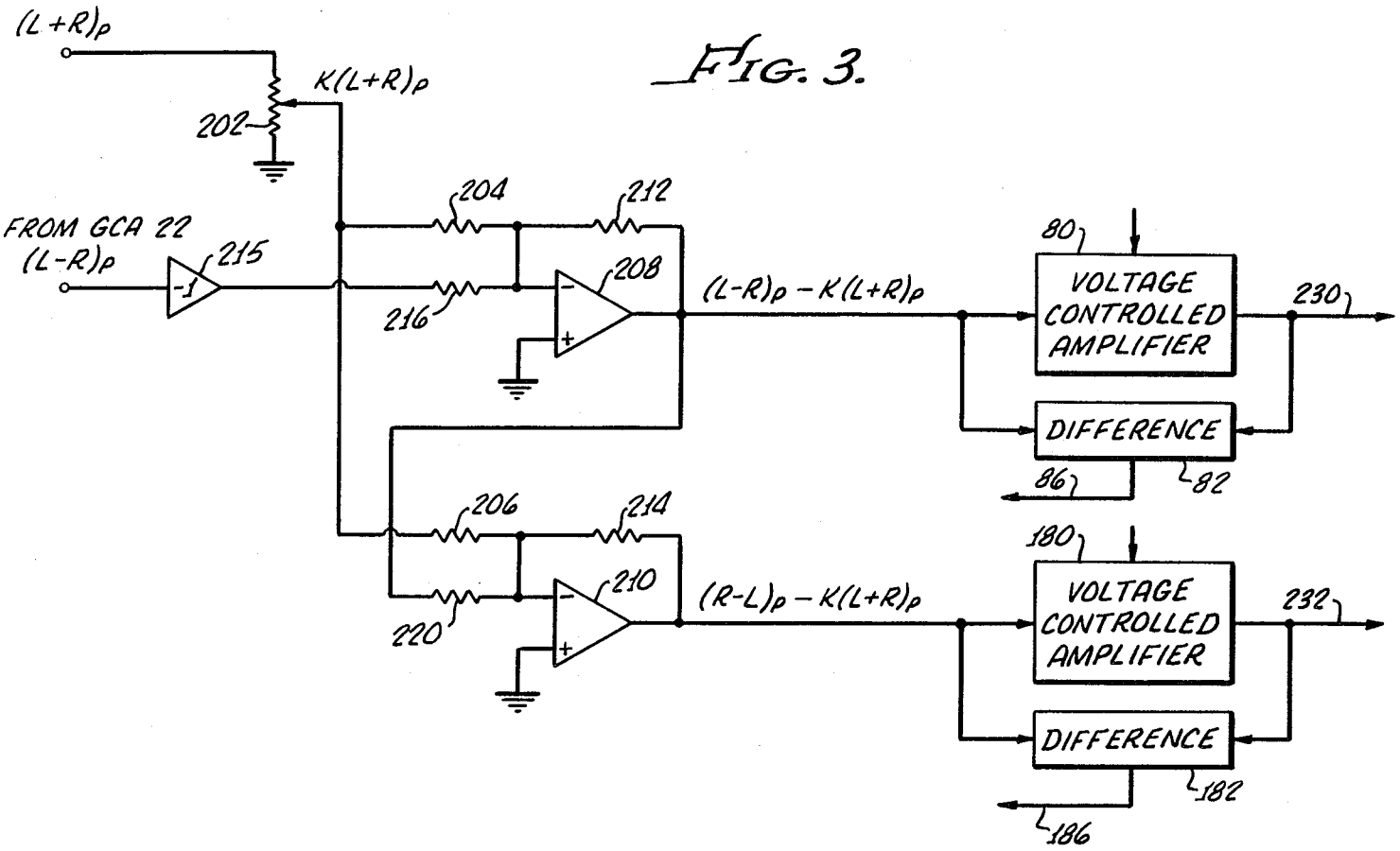
FIGS. 3 and 4 show a modification in which a portion of the sum signal is enhanced together with the difference signal.
Figure 4:
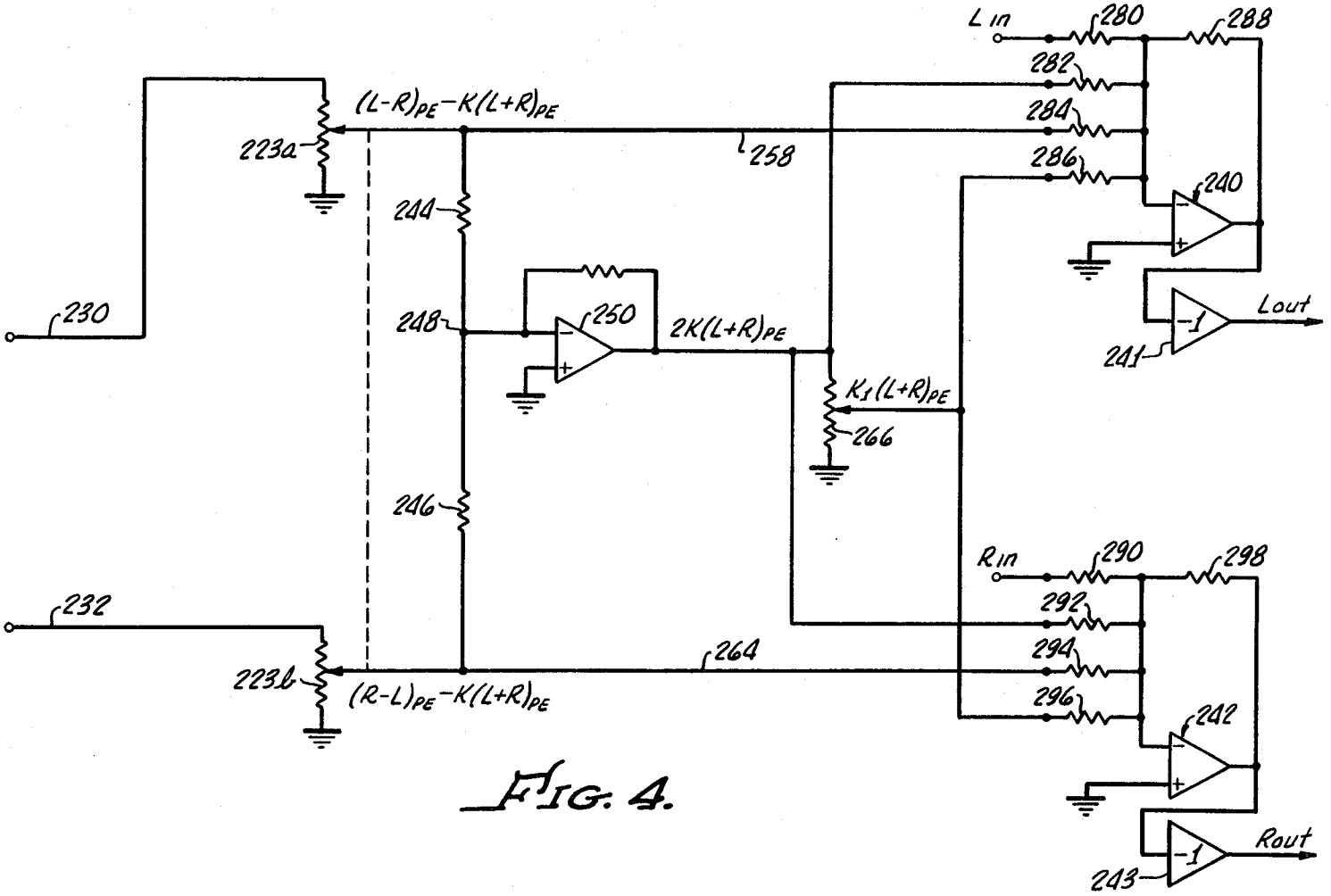
Figure 12:
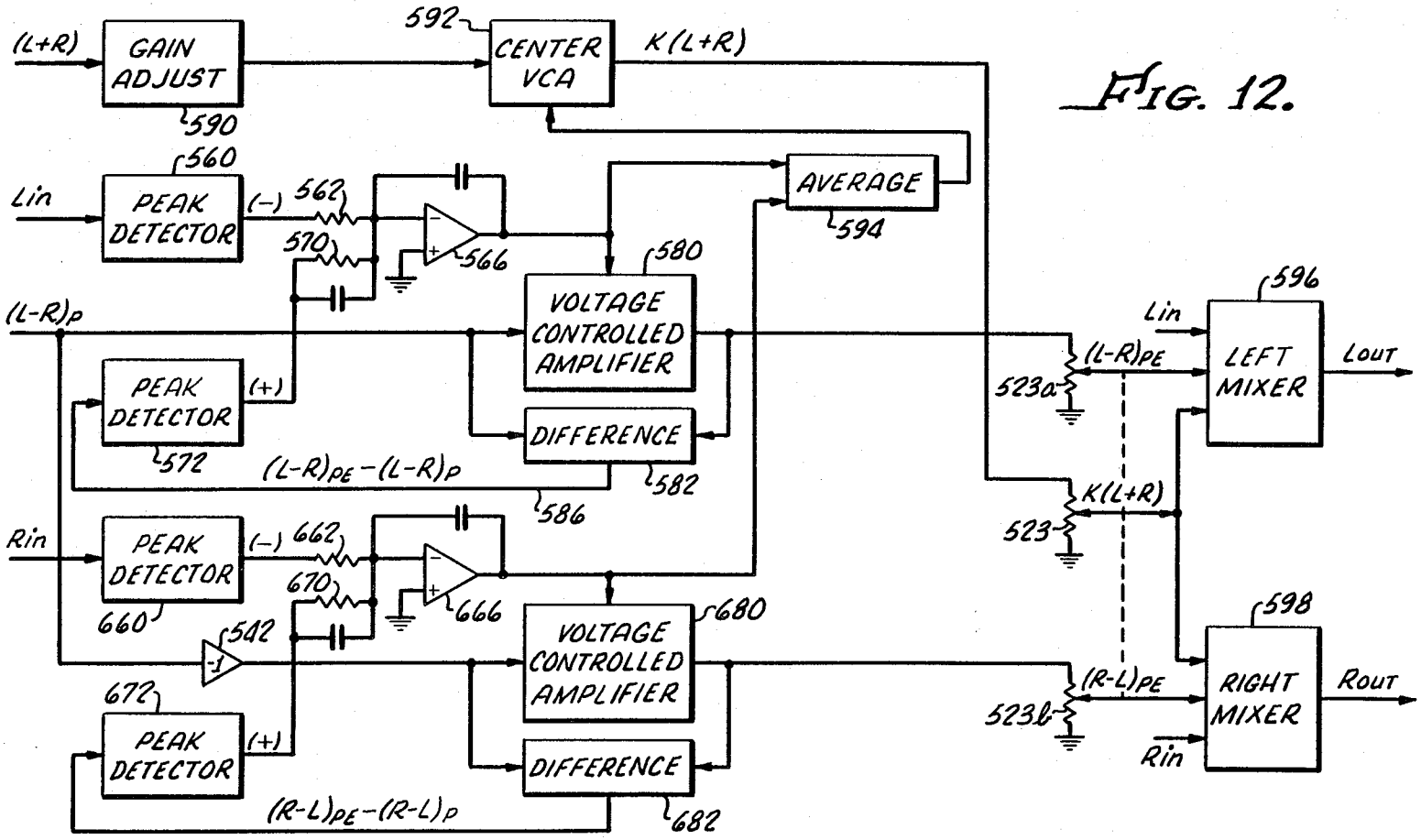
FIG. 12 illustrates a form of directivity servo employing a modified version of sum signal enhancement.

Under some conditions, particularly in a television or movie presentation, where the scene is such that loud side noises, such as gunfire, approaching vehicles, laterally displaced instruments, or the like, occur together with dialogue at the center of the sound image, the enhancement of the directivity of the side sounds may tend to overwhelm or at least partially drown out the center stage dialogue. To avoid such a situation, center stage dialogue sounds may be dynamically enhanced, or boosted, to partially overcome this tendency to be drowned out. To accomplish such center stage sound enhancement, an arrangement is employed as illustrated in FIGS. 3 and 4. These figures show an exemplary circuit for adding a fraction of the processed sum signal $(L+R)_p$ to the input provided to the voltage controlled amplifiers 80 and 180 of the respective channels. This causes the directivity servos to enhance not only the processed difference signal but a fraction of the processed sum signal as well. Addition of a fraction of $(L+R)_p$ is shown in FIG. 3. Separation and independent amplitude control of the directivity enhanced $(L+R)_{pe}$ component is shown in FIG. 4. An alternative arrangement for dynamically enhancing a portion of the sum signal and combining it with the directivity enhanced difference signals is shown in FIG. 12 and described below.

The circuit of FIGS. 3 and 4 depict an alternative arrangement for providing input to the directivity servos. It is used instead of the input shown in FIG. 2 if the system is to be built so that center stage drowning out is avoided. FIG. 4 shows the modified handling of directivity servo outputs and other signals that is used with the circuit of FIG. 3.

As shown in FIG. 3, the processed sum signal $(L+R)_p$ from the dynamic sum equalizer 21 (FIG. 1) is fed to an attenuating potentiometer 202 from which is derived the signal $K(L+R)_p$. Where a feedback of the directivity servo of about three to one is employed, as previously described, the value of K may be in the order of one quarter, so that potentiometer 202 will provide a processed sum signal having an amplitude of approximately one quarter the amplitude of the processed sum signal that is provided from the dynamic sum equalizer 21. The attenuated processed sum signal is fed via resistors 204,206 to the respective inverting inputs of first and second inverting operational amplifiers 208,210, having feedback resistors 212, 214 respectively. A second signal provided to the inverting input of amplifier 208 via a resistor 216 and an inverter 215 is the processed difference signal $-(L-R)_p$ from gain controlled amplifier 22 of FIG. 1. With resistors 204,212, and 216 of amplifier 208 all being equal to one another, the output of the amplifier is the sum of the difference and sum signal portions applied to and summed at its inverting input. This output is $(L-R)_p - K(L+R)_p$.

A second signal provided to the inverting input of amplifier 210 via a resistor 220 is the output of amplifier 208. However, since the phase of the output of amplifier 210 is opposite that of the output of amplifier 208 (for the same reasons that inverter 42 of FIG. 2 is employed to invert $(L-R)_p$ in the lower channel of FIG. 2), it is necessary to scale the $(L+R)_p$ component seen by amplifier 210. This is done by making resistors 220 and 214 equal to one another, and each having a value twice that of resistor 206, which feeds the processed sum signal to amplifier 210. Effectively this scaling of the resistors provides a processed sum signal component in the output of amplifier 210 (derived from the processed sum signal component of potentiometer 202), which is doubled. But since the other input (from the output of amplifier 208) via resistor 220 of amplifier 210 also provides a component of the processed sum signal $-K(L+R)_p$ of opposite phase (relative to the phase of the processed sum signal from potentiometer 202), the two opposite phase processed sum signals are effectively subtracted in amplifier 210, and the net result is the component $-K(L+R)_p$ of proper phase in the output of amplifier 210. Note that a processed sum signal component is fed via the smaller resistor 206 with one phase from potentiometer 202 whereas the opposite phase of the processed sum signal is fed via resistor 220 from the output of amplifier 208. Thus the resulting output of amplifier 210 is $(R-L)_p - K(L+R)_p$, and the output of amplifier 208 is $(L-R)_p - K(L+R)_p$. It will be seen then that each of the left and right channel signals has added to it the same amount of processed sum signal. As previously mentioned, this is but a fraction of the processed sum signal and is employed to overcome the effect of drowning out of center stage sound.

The output of amplifier 208 is fed to the voltage controlled amplifier 80, having an output on line 230, just as is the signal $(L-R)_p$ of FIG. 2. Similarly the output of amplifier 210 is fed to the input of voltage controlled amplifier 180, having an output on line 232, just as is the output of inverter 42 of FIG. 2. All other components of the directivity servo illustrated in FIG. 2 (not shown in FIG. 3) are also employed in the arrangement of FIG. 3. It will be understood then that FIG. 3 only shows the modification of the inputs to the voltage controlled amplifiers of FIG. 2, with all remaining portions of the directivity servos remaining the same as are illustrated in FIG. 2. However, the servo outputs are handled differently, as will be described below in connection with FIG. 4.

The result of the center stage enhancement is to cause the directivity servo to perform its operations on both the difference signal and a portion of the sum signal, so that effectively the directivity enhancement is applied to both sum and difference signals, but applied more strongly to the difference signal.

It is desirable to separately control amplitude of the boosted and enhanced sum signal component $(L+R)_{pe}$ that appears, together with boosted and enhanced difference signal components $(L-R)_{pe}$ and $(R-L)_{pe}$, on output lines 230 and 232 of the circuit of FIG. 3. In other words, it is preferred to be able to control relative amplitudes of these two components. This is desired because the enhancement or boost of the sum signal component by the directivity servo may be too large. Therefore the boosted and enhanced sum signal component is separated and attenuated as shown in the circuit of FIG. 4 and then combined with other components in the mixer. In order to be able to separately and independently control amplitude of the enhanced sum component $(L+R)_{pe}$, this component must be separated from the enhanced difference signal components $(L-R)_{pe}$ and $(R-L)_{pe}$ at the outputs 230 and 232 of the directivity servos of FIG. 3.

As shown in FIG. 4, the output of the left channel directivity servo of FIG. 3 on line 230 and the output of the right channel directivity servo of FIG. 3 on line 232 are fed to a pair of ganged stereo image width adjusting potentiometers **223*a* and 223*b*, which correspond to (are used in place of) potentiometers 23*a* and 23*b* of FIG. 1. In the arrangement of FIG. 1 the output of these ganged potentiometers, which control width of the apparent stereo image, are fed directly to the mixer, together with $R_{in}$, $L_{in}$ and $(L+R)_p$. The arrangement of FIGS. 3 and 4 is different. Where part of the sum signal is being processed and enhanced, the outputs of ganged width adjusting potentiometers 223*a* and 223*b* are fed to the mixers, as shown in FIG. 4. The mixers comprise summing amplifiers 240 and 242. Circuitry illustrated in FIG. 4 separates out the processed and enhanced sum signal component for independent control of its amplitude relative to amplitude of the processed and enhanced difference signal component. As will be later described, the mixers also receive the stereo inputs $L_{in}$ and $R_{in}$, but do not receive the processed sum signal $(L+R)_p$. Instead the mixers receive the processed enhanced sum signal $(L+R)_{pe}$ via the circuitry of FIG. 4**.

The signals from potentiometers **223*a* and 223*b*, are respectively $(L-R)_{pe} - K(L+R)_{pe}$ and $(R-L)_{pe} - K(L+R)_{pe}$ (The constant K in these components includes the attenuation caused by the width adjusting potentiometers). These signals are combined in a voltage divider composed of resistors 244,246 so that at the junction 248 of these resistors the opposite phase difference signal components cancel one another. The remaining sum signal component at junction point 248 is fed to the inverting input of a differential amplifier 250, which accordingly provides as its output the sum of the signals fed to it via voltage divider resistors 244,246. With the difference signal components of opposite phase being canceled by this summation, the output of amplifier 250** is effectively $+2K(L+R)_{pe}$. Thus a processed and enhanced sum signal component is provided independent of the processed enhanced difference signal components.

The sum signal component is suitably adjusted in amplitude by feeding it through a second independent amplitude control potentiometer 266 (the first is potentiometer 202 of FIG. 3), from the output of which appears the amplitude adjusted processed and enhanced sum signal component $+K_1(L+R)_{pe}$, where constant symbol $K_1$ is employed merely to indicate that the amplitude of this component differs from the amplitude of the sum component that emanates from the directivity servos.

The left channel mixer is formed of the amplifier 240, having a resistive summing network input comprised of resistors 280,282,284 and 286, all connected in common to the inverting input of the amplifier and to an amplifier feedback resistor 288. The output of mixer amplifier 240, after inversion in an inverter 241, is $L_{out} = -L_{in} + K_4(L+R)_{pe} + K_5(L-R)_{pe}$. This is fed to the left channel speakers, with additional amplification, if desired. Resistor 280 receives the left channel stereo input signal $L_{in}$. Resistor 282 receives the output of amplifier 250, which is the processed and enhanced sum signal component before its attenuation in potentiometer 266. Resistor 284 is fed with the processed and combined difference and sum signal components from the wiper arm of potentiometer **223*a*, and resistor 286 also receives a processed and enhanced sum signal component, but a component which has been selectively attenuated by the potentiometer 266. The several resistors 280,282,284 and 286 and feedback resistor 288 are relatively proportioned to provide a desired relation of amplitudes of the several inputs to the mixer amplifier 240. In a presently preferred embodiment the values of these resistors are as follows: resistor 280, 10K, resistor 282, 10K, resistor 284, 5K, resistor 286, 5K, and resistor 288, 26K. The independently amplitude adjustable sum component from potentiometer 266 is fed to the mixer 240 through resistor 286, and thus allows independent control of the effective magnitude of the combined portions of the sum signal that are fed to the amplifier via the two resistors 282 and 286**.

The right channel mixer amplifier 242 is substantially identical to the left channel amplifier and its summing network. Thus right channel mixer amplifier 242 is provided with a resistive input summing network comprised of resistors 290, 292, 294,296 and a feedback resistor 298, all connected to the inverting input of the amplifier, which has its non—inverting input grounded, as does amplifier 240. The output of right channel mixer amplifier 242, after inversion in an inverter 243, is $R_{out} = R_{in} + K_4(L+R)_{pe} + K_5(R-L)_{pe}$. This is fed to the right channel speakers, with additional amplification, if desired. Resistor 290 receives the right stereo input signal $R_{in}$. Resistor 292 receives the amplified processed and enhanced sum signal component from the output of amplifier 250. Resistor 294 receives the processed and enhanced difference signal component on line 264 of the right channel, and resistor 296 receives the output of potentiometer 266, which is also fed, as previously described, to resistor 286 of the left channel. The relative values of resistors 290,292,294,296 and 298 are the same as the relative values of the corresponding resistors of the left channel, so that in the above-mentioned preferred embodiment the values are as follows: resistor 290, 10K, resistor 292, 10K, resistor 294, 5K, resistor 296,5K, and resistor 298, 26K.

The relative values of the resistors at the input to the mixers effect an increase of the difference signal amplitudes with respect to sum signal amplitudes. This relative boost of the difference signal does not affect and is not part of the difference signal enhancement (for improved stereo sound image) accomplished by the equalizers 18,19,21 and amplifiers 22 of FIG. 1 or by the servoed equalizers of FIGS. 7 and 9, but is provided merely as compensation for a fixed amplitude decrease of the difference signal. Such amplitude decrease is provided by amplitude control circuitry (not shown) prior to the difference signal enhancement. This fixed amplitude decrease (not shown) enables the enhanced difference signal amplitudes to remain below a value at which amplitude clipping might otherwise occur in the various amplifiers.

The described directivity servo is particularly useful with the stereo image enhancement circuit of my prior patent identified above. Nevertheless, it will be readily appreciated that principles of the present invention may be applied to other stereo systems providing left and right channel sound of which the directivity is desirably enhanced.

Stereo Enhancement With Multi-Channel Servoed Equalization

Figure 5:
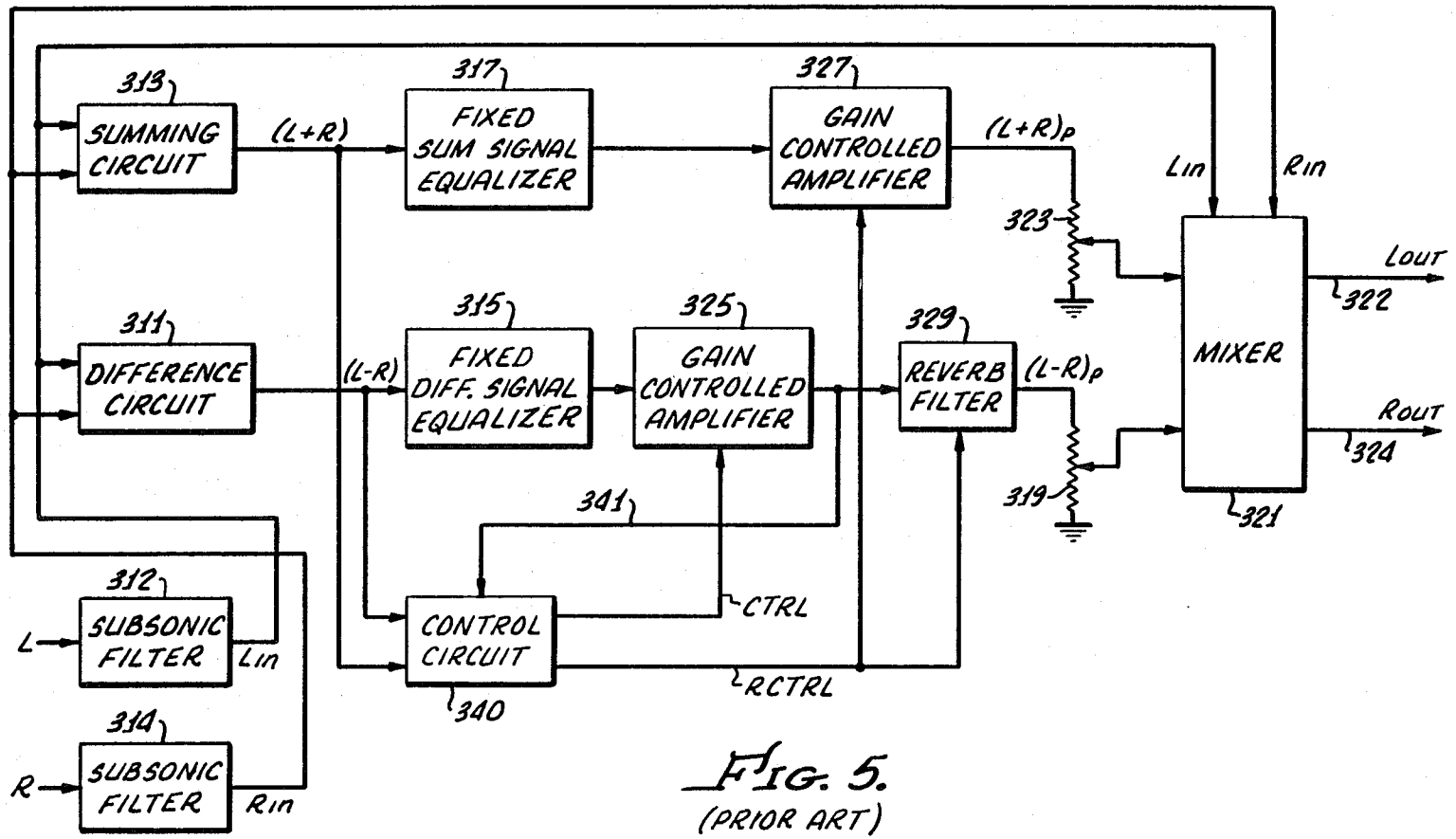
FIG. 5. (PRIOR ART)
FIG. 5 shows the circuit of my prior patent No. 4,748,669, which includes automatic reverberation control.

The arrangement of the directivity servos illustrated in FIGS. 3 and 4 results in the creation of a dynamically enhanced sum signal at the wiper arm of potentiometer 266. This signal is directly useful in an improved version of the stereo enhancement system of FIG. 1 and also in a simplified version of the enhancement system of FIG. 1 that is shown in FIG. 5. The stereo enhancement system shown in FIG. 5, like that of FIG. 1 (but without the directivity servos of FIG. 1), is shown and described in greater detail in my prior U.S. Pat. No. 4,748,669, for Stereo Enhancement System, issued May 31, 1988, and assigned to the assignee of the present application. The disclosure of this patent is incorporated herein as though fully set forth. In the stereo enhancement system of my prior patent, enhancement of the stereo image is performed by equalization circuits that effectively boost signal components in lower and upper frequency bands of the difference signal and by a servo circuit that maintains a selected ratio of processed difference signal to sum signal. These circuits also operate on artificial reverberation that may be introduced into the input. Thus the system of my prior patent employs automatic reverberation control in various forms to eliminate or compensate for undesired effects (e.g. undesired boost) of the stereo image enhancement on the artificially introduced reverberation.

In the system illustrated in FIG. 5, which system is also shown in FIG. 4 of my prior patent, left and right channel stereo inputs are fed to subsonic filters 312,314 and thence to difference and summing circuits 311 and 313 to provide difference and sum signals (L−R) and (L+R) respectively. These signals are fed to a fixed difference signal equalizer 315 and a fixed sum signal equalizer 317. The output of the fixed difference signal equalizer is fed to a gain controlled amplifier 325 under control of a signal CTRL from a control circuit 340 that receives as inputs the signals (L+R) and (L−R) and also receives a feedback signal on a line 341 from the output of voltage (gain) controlled amplifier 325. The control circuit 340 also provides a reverberation control signal RCTRL which is fed to provide a small amount of boost to the signal (L+R) from equalizer 317 via a gain controlled amplifier 327 from the output of which appears the processed sum signal $(L+R)_p$. The output of amplifier 325, which is the processed difference signal, is fed through a reverberation control filter 329, which is also controlled by the reverberation control system RCTRL, to provide the processed difference signal $(L-R)_p$. The processed difference and sum signals are fed to ganged width control potentiometers 319 and 323 from the wiper arms of which are provided the processed difference and sum signals that are fed to a mixer 321. The mixer also receives the left and right channel stereo input signals, combines these and provides left and right output signals $L_{out}$, $R_{out}$ on lines 322 and 323 respectively.

The reverberation filter 329 is provided to effectively attenuate certain mid-band frequencies in the presence of sensed artificial reverberation. Generally a vocalist or soloist is recorded so as to appear at center stage, and thus the soloist sound appears primarily in the sum signal (L+R). The processed difference signal at the output of amplifier 325 is effectively servoed to the sum signal (L+R) so as to maintain a predetermined fixed ratio between the processed difference signal and the sum signal (all as explained in detail in my prior patent). Therefore, an increase in (L+R), such as may be caused by artificially induced reverberation, for example, may result in undesired increase in the enhancement effect of the system on certain of the difference signal components. For this reason the reverberation filter 329 is employed in the system of my prior patent so as to selectively attenuate the difference signal in the frequency band of about 300 to 4,000 Hz, when excess reverberation is sensed.

To sense excess reverberation, the system of my prior patent senses an increase in the sum signal (L+R) from a preselected balanced condition and operates on the assumption that such an increase in (L+R) is due at least in part to artificially induced reverberation. In addition to attenuating a mid-band of frequencies in response to sensed reverberation, the sum signal is boosted (to a lesser degree) by means of amplifier 327 under control of RCTRL.

Figure 6:
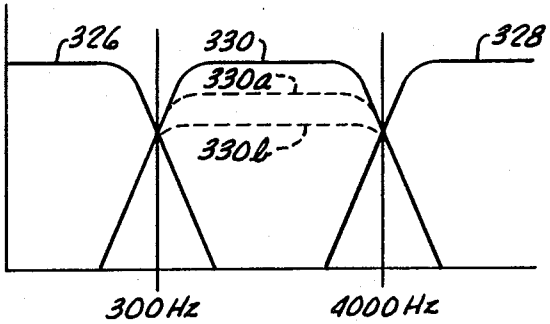
FIG. 6. (PRIOR ART)
FIG. 6 illustrates characteristics of the reverberation filter of the circuit of FIG. 5.

Reverberation filter 329 is described in my prior patent as having characteristics generally illustrated in FIG. 6, including a low channel filter indicated by curve 326, a high channel filter indicated by curve 328, and a mid-band channel filter indicated by curve 330, having cross over points at about 300 Hz and 4,000 Hz respectively, with the filters having sharp cut off and rise times. The center channel of this reverberation filter provides a variable attenuation under control of the signal RCTRL from control circuit 340, and thus the center channel response may vary from curves 330 to 330*a* or 330*b*, as illustrated in FIG. 6, as the amount of sensed reverberation changes.

In order to improve the circuit of FIG. 5, to make it more automatic, to make it more simple and less expensive, applicant has developed a stereo enhancement system which provides the desirable effects of FIG. 5, but which eliminates the reverberation filter. Such an improved arrangement is illustrated in block form in FIG. 7. This arrangement employs a multi-channel, low pass servoed equalizer in the place of the fixed sum and difference signal equalizers 315,317 of FIG. 5, and also in the place of the gain controlled amplifiers 325,327, control circuit 340, and reverberation filter 329.

Figures 7, 11:
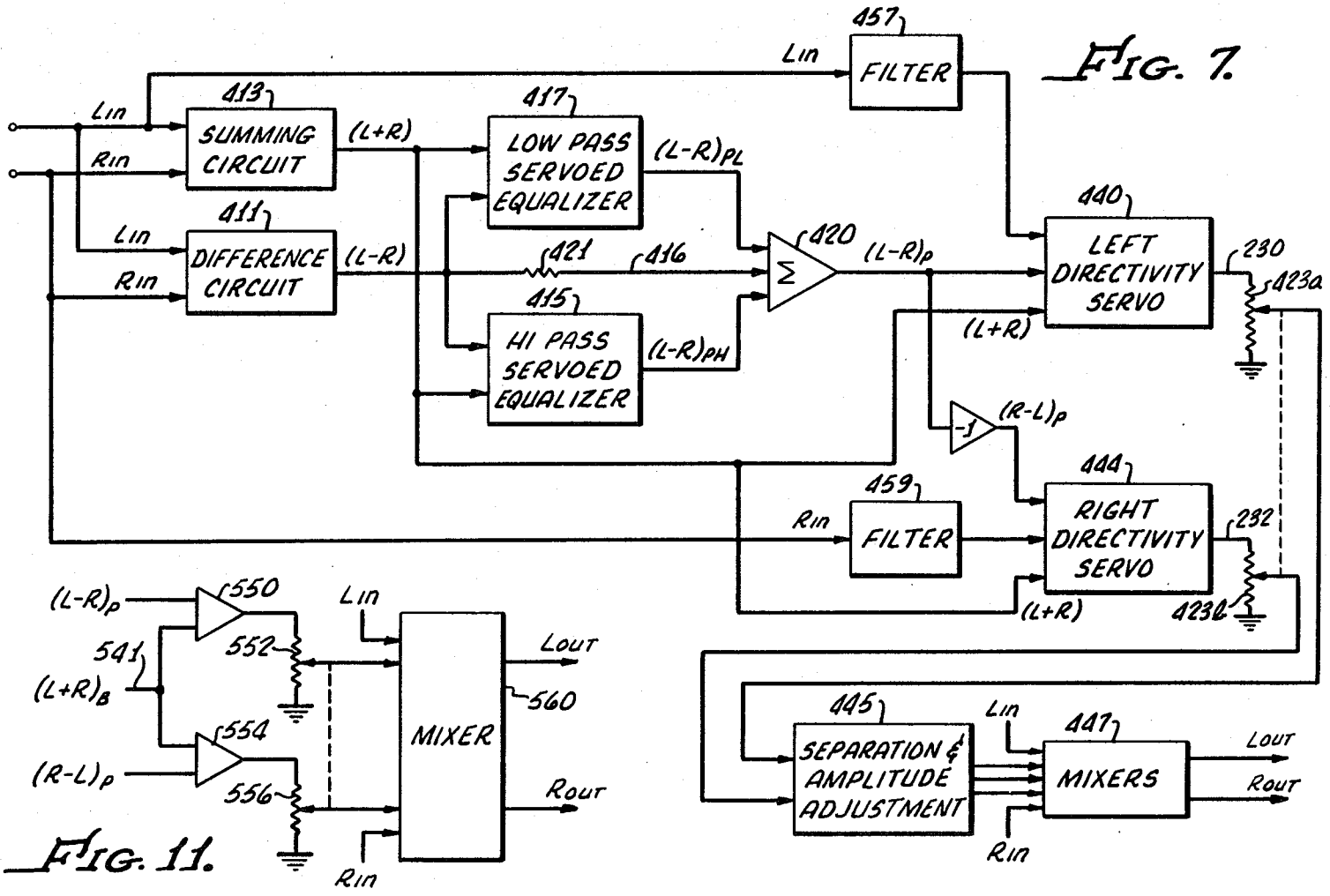
FIG. 7 is a block diagram of a multiple band servoed equalizer for use with the described stereo enhancement system.
FIG. 11 shows the manner of combining dynamically boosted sum signal with processed difference signals, where no directivity servos are used.

As illustrated in FIG. 7, left and right input signals are fed to a difference circuit 411 and a summing circuit 413 to provide the difference and sum signals (L−R) and (L+R) respectively. Instead of feeding these signals to either dynamic equalizers or fixed equalizers for sum and difference signals, the sum and difference signals are fed to high and low pass servoed equalizers 415,417. Thus the difference signal is fed to both the low and high pass servoed equalizers, and the sum signal is fed to both the low and high pass servoed equalizers. (In this connection, the sum signal is used only as a reference, as will be described below.) The low and high band processed outputs $(L-R)_{pl}$ and $(L-R)_{ph}$ of these two separately servoed equalizer channels are combined with the unprocessed difference signal (L−R) in a summing amplifier 420 to provide the processed difference signal $(L-R)_p$. This signal and the sum signal (L+R) are fed to left and right directivity servos 440,444, which are basically the same as the directivity servos of FIG. 1, and, more particularly, are identical with that version of the directivity servos shown in FIGS. 3 and 4, described above. The inputs to these servos are as shown in FIG. 3, with the sum signal (L+R) from summing circuit 413 being provided to inverting amplifier 200 of FIG. 3, and the difference signal $(L-R)_p$ from summing amplifier 420 being fed to inverter 215 of FIG. 3. Similarly the signals $L_{in}$, $R_{in}$ are also fed to the directivity servos, as previously described via filters 457 and 459 respectively. Most of the components of the system of FIG. 7 are similar to or correspond to components of FIG. 1, and such components in FIG. 7 are identified by the same reference numerals as in FIG. 1, except that in FIG. 7 the reference numerals are prefixed by the numeral 4. Thus summing circuit 413 of FIG. 7 corresponds to summing circuit 13 of FIG. 1, and difference circuit 411 of FIG. 7 corresponds to difference circuit 11 of FIG. 1, for example. Similarly, the corresponding elements of the circuit of FIG. 5 employ the same reference numerals as employed in FIG. 1, but in FIG. 5 such numerals are prefixed by the numeral 3, so that, for example, summing circuit 313 of FIG. 5 corresponds to circuits 13 and 413 of FIGS. 1 and 7 respectively.

It will be see that FIG. 7 comprises a modification of the circuit of FIG. 5 in which the equalizers, gain controlled amplifiers, control circuit and reverberation filters are replaced by the low pass servoed equalizer and high pass servoed equalizer, together with summing circuit 420, and in which the left and right directivity servos have been interposed between the equalizer processing circuits and the mixer in the manner illustrated in FIG. 1. Outputs of the left and right directivity servos 440,444 are fed to ganged width adjusting potentiometers 423*a* and 423*b* (identical to the corresponding components 223*a*,223*b* of FIG. 4). The outputs from the wiper arms of the width adjusting potentiometers 423*a*,423*b* are fed to separation and amplitude adjustment circuitry 445 illustrated in detail in FIG. 4 and thence to the mixers 447. The left and right stereo outputs to be provided to the speakers, with or without additional amplification are provided as the outputs of the mixer 447.

In the arrangement of FIG. 7, instead of equalizing the entire difference signal, the signal is divided into several different frequency bands, which have somewhat greater separation than the bands employed in the reverberation filter of FIG. 5, having the characteristics shown in FIG. 6. Thus there is provided the low pass servoed equalizer 417 that will handle the low band signals up to about 237 Hz. The high pass servoed equalizer 415 of FIG. 7 is provided to handle the high frequency components, above about 7,000 Hz. A center channel comprising a line 416 feeds the difference signal (L−R) directly to the summing amplifier 420 (via a resistor 421) as will be described below. It will be noted that, as presently preferred, the upper and lower frequency bands are not overlapping, but are separated from each other by the center band which extends between about 237 Hz and 7,000 Hz. By equalizing the high and low pass bands separately and independently, and, at the same time, servoing these high and low pass bands of the difference signal to corresponding high and low pass bands of the sum signal, any undesired enhancement of the mid-frequency band caused by artificially induced reverberation is avoided. In effect, then, by employing the enhancement servos only in low and high pass bands, stereo image enhancement is provided without unnecessarily and undesirably enhancing sounds induced by artificially induced reverberation, and thus the need for any reverberation control filter is eliminated. As described in my prior patent these low and high bands are, effectively, the frequencies in which difference signal components generally have lower amplitude, e.g. the frequencies in which the difference signal sound is quieter.

Figure 8:
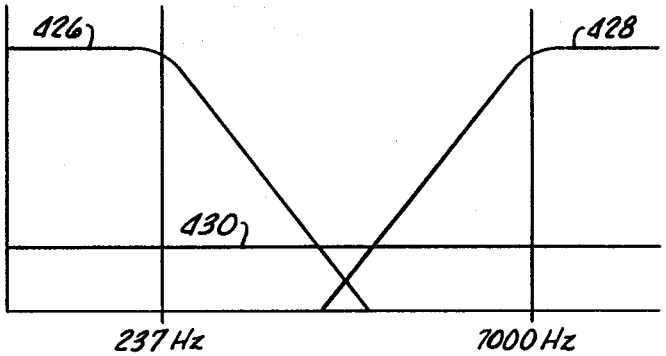
FIG. 8 illustrates characteristics of the circuit of FIG. 7.

FIG. 8 shows the effective response of the high and low pass servoed equalizers of FIG. 7. Curve 426 (corresponding to curve 326 of FIG. 6) shows the low pass servoed equalizer 417 having a cut off at about 237Hz, and a fall off thereafter of about 6 dB per octave. Curve 428 (corresponding to curve 328 of FIG. 6) shows the high pass servoed equalizer 415 response curve, having a relatively slow rise of 6 dB per octave to about 7,000 Hz, above which the response for the high pass servoed equalizer channel is substantially flat. Curve 430 illustrates the flat, relatively attenuated, response of the straight through resistive line 416 of FIG. 7. Thus, effectively, it will be seen that the low pass and high pass servoed equalizers of FIG. 7 provide the desired filtering corresponding to the reverberation filter 329, but without the deleterious effects of mid−band servoing of the difference signal components. As will be described below, the circuits effectively provide varying amounts of boost in such upper and lower bands to maintain the described ratio of processed difference to sum signals independently in each band.

Figure 9:
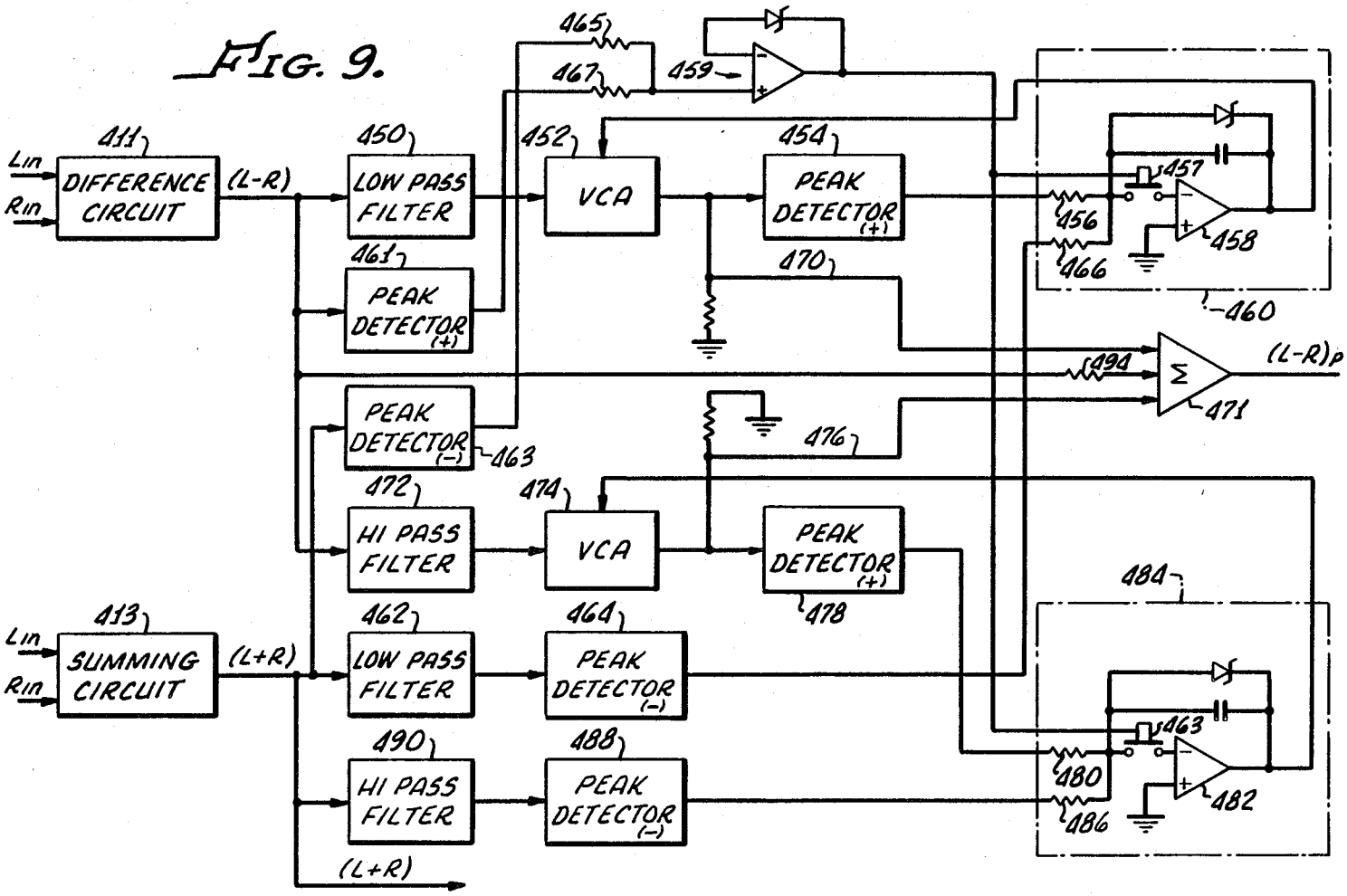
FIG. 9 is a detailed block diagram of the multiple band servoed equalizer of FIG. 7.

Details of the low pass and high pass servoed equalizers are illustrated in FIG. 9. Left and right input signals are fed to the difference and summing circuits 411,413 respectively, as previously described. The difference signal (L−R) from circuit 411 is fed to a low pass filter 450, having the characteristic of curve 426 of FIG. 8, from the output of which the signal is fed to a gain controlled amplifier (VCA) 452. The output of amplifier 452 is fed to a non-inverting peak detector 454, the DC output of which provides a DC signal representing the amplitude envelope of the low pass servoed and processed difference signal components. This is fed with one polarity as a first input via a summing resistor 456 to a summing amplifier 458 of a control signal generating circuit 460. Circuit 460 performs an integrating function and, with certain simple changes, is nearly the same as the corresponding control circuit 50 of FIG. 3 of my prior U.S. Pat. No. 4,748,669. The circuit also includes several feedback paths for amplifier 458, providing integration and zener diode voltage limiting.

The sum signal (L+R) from summing circuit 413 is similarly fed to a corresponding low pass filter 462, having the same response characteristics as filter 450, and thence to an inverting peak detector 464, which provides a second DC input, of polarity opposite that of the signal fed to resistor 456, to the amplifier 458 via a second summing resistor 466. The output of amplifier 458 is fed back as a control signal for voltage controlled amplifier 452 so that the output of the amplifier 452, on a line 470, provides the servoed and processed low pass component $(L-R)_{pl}$ of the difference signal. This is fed as a first input to summing amplifier 471 (which corresponds to summing amplifier 420 of FIG. 7).

The signal (L−R) is also fed through the high pass servo equalizer channel which includes a high pass filter 472, having the response characteristics illustrated by curve 428 of FIG. 8. The output of the filter 472 is fed to a second voltage controlled amplifier (VCA) 474, which provides as its output on a line 476 the high pass servoed and equalized difference signal component $(L-R)_{ph}$ that is fed as a second input to the summing amplifier 471.

The output ~~of~~ voltage controlled amplifier 474 is also fed to a non-inverting peak detector 478, from the output of which is provided a DC signal representing the amplitude envelope of the high pass servoed and processed difference signal component from amplifier 474 and fed via a first summing resistor 480 to the input of a second control circuit amplifier 482. The control circuit of amplifier 482, indicated to be included in dotted box 484, is identical to the control circuit 460 of the low pass servo equalizer channel. A second DC input to amplifier 482 via a second summing resistor 486 is provided from the output of an inverting peak detector 488, which receives the output of a high pass filter 490, having a response characteristic the same as is shown by curve 428 of FIG. 8, which is the same response characteristic as high pass filter 472. The several peak detectors provide outputs which are the amplitude envelopes of their respective inputs. The input to high pass filter 490 is the sum signal (L+R) from summing circuit 413. The output of amplifier 482, in a manner similar to the output of the low pass channel amplifier 458, is fed back to control operation of voltage controlled amplifier 474, and thus to control magnitude of the processed and servoed high pass difference signal component $(L-R)_{ph}$ on line 476. The servoed and processed low and high pass difference signal components on lines 470 and 476 are combined with the unprocessed difference signal (L−R), fed to the summing amplifier 471 via a resistor 494. Thus, at the output of summing amplifier 471 appears the processed difference signal $(L-R)_p$, which includes separately mutually independently servoed and equalized low pass and high pass difference signal components. The processed difference signal also includes a wide band (the entire audio bandwidth of the system) difference signal component simply attenuated by resistor 494.

For integrating circuit 460 of FIG. 9, the output of resistor summing network 456,466 is fed to the inverting input of the amplifier 458 via a switch 457, which is operated in response to the output of a comparison circuit 459 that compares the output of an inverting peak detector 463, that receives the sum signal (L+R), with the output of a non−inverting peak detector 461 that receives the difference signal (L−R). The output of comparison circuit 459 is also employed to operate a switch 463 connected between the inverting input of amplifier 482 of circuit 484 and the resistors 480, 486 of this circuit, and, if desired, to also operate similar switches (not shown) connected between the inverting inputs of directivity servo integrating amplifiers 66,166 (FIG. 2) and the input resistors f these amplifiers. The purpose of these switches is to disable operation of the enhancing circuitry (and, if desired, the directivity servos) in the absence of stereo. Switches 457,463 operate in the same manner as do the corresponding switched zener diodes in the feedback circuits of the corresponding integrating amplifiers of my prior patent. In the circuit illustrated in FIG. 9, the output of difference signal peak detector 461, which is in effect a stereo detector, is compared to the output of sum signal peak detector 463 in the resistive summing circuit 465,467 provided at the input to the comparator 459. If the output of peak detector 461 is below a predetermined fraction, such as one fifth, of the output of peak detector 463 (e.g., the difference signal is very low compared to the sum signal), the output of the comparator 459 operates to open switches 457 and 463, thereby disabling the stereo enhancement (and, if desired, the directivity servos). When the amount of stereo increases, such that the difference signal envelope amplitude at the output of peak detector 461 is effectively greater than one fifth of the sum signal envelope amplitude at the output of peak detector 463, the comparator output closes switches 457,463, and the enhancement circuitry is operable as described. The ratio of five to one, sum signal to difference signal, is defined by the relative values of resistors 465,467. Obviously, this ratio may be changed, as desired.

In each of the low pass and high pass servo equalizer channels, the respective low and high pass components of the difference signal are effectively compared individually with the corresponding low or high pass component of the sum signal in the resistive summing network inputs to amplifiers 458 and 482 respectively. In each case the summing network resistor values are chosen to maintain a desired and fixed relation (ratio of amplitudes) of the processed difference signal component of the particular band to the sum signal of the corresponding band. In general it is preferred that the resistance of resistor 456, which feeds the processed difference signal component, be at least as great as the resistance of resistor 466 which feeds the sum signal component. It is contemplated that the ratio of resistors 456 to 466 be in the order of about one to one to about three to one (resistor 456 being larger in the latter case). As this ratio of resistor 456 to 466 is made higher (preferably the ratio is fixed for a given system, although it may be made selectively variable within the stated limits), the servoing action maintains an increasingly greater amplitude of the low pass precessed difference signal component relative to the low pass unprocessed sum signal component. Where the system illustrated in FIG. 9 is employed with the directivity servos illustrated in FIGS. 3 and 4, or in FIG. 12, a one to one ratio of resistors 456 to 466 is acceptable, because the directivity servo itself provides additional enhancement and boosting of the difference signal components.

The considerations stated above, which govern relative values of input resistors 456, 466 of the low pass channel, apply equally to the input resistors 480 and 486 of the high pass channel. Accordingly these resistors will have a ratio in the range of one to one to three to one. In other words, resistor 480 will be at least equal to or greater than resistor 486, so that the high pass servoed and equalized (processed) difference signal component will be greater than the unprocessed sum signal component of the high pass band.

The output of summing amplifier 471, which is the processed signal $(L-R)_p$, is fed to the directivity servos as described in connection with FIG. 3 (or to the directivity servo as shown in FIG. 12 and described below). Thus the output of summing amplifier 471 is fed to inverter 215 of FIG. 3, instead of the signal previously described as being received from gain control amplifier 22. Similarly the sum signal from summing circuit 413 (which receives no processing up to this point) is fed to inverter 200 of FIG. 3 instead of the signal $(L+R)_p$ illustrated in FIG. 3. With these inputs to the circuit of FIG. 3 from the circuit of FIG. 9, the directivity servo is exactly as previously described, with the circuit elements of FIG. 3 providing outputs on lines 230 and 232 which are fed to the circuit of FIG. 4 to provide the desired system outputs.

The system described to this point will provide significant servoed boost of the low frequency band and high frequency band of the difference signal, each of the two bands being boosted independently of the other. Such boost or enhancement occurs to a degree at which it may tend to swamp or drown out a center stage sound, such as would be carried by the sum signal (L+R). In other words, the system described up to this point might cause center stage sound as embodied in the sum signal (L+R) to appear subjectively to the listener to fade into the background. Therefore, with this simplified servo equalized system, it is preferred to provide a dynamic boost of the sum signal (L+R). As previously mentioned, such a dynamically boosted sum signal is provided in the directivity servo, and in particular, in the circuit of FIG. 4 at the wiper arm of potentiometer 266. This circuit provides a dynamic boost of the sum signal, because the nature of the directivity servo, as described above, is such as to sense an increase in the input stereo signal and provide a greater increase in the resulting processed sum and difference signals. Accordingly, when the servoed equalizer arrangement of FIG. 9 is employed to provide inputs to the directivity servo, a slight adjustment is made to the wiper arm of potentiometer 266 (at which only a dynamically boosted sum signal component appears) to provide a slight degree of increase in the amplitude of the signal appearing on its wiper arm. Thus the circuits of the directivity servo, which effectively result in signals which include the dynamically boosted sum signal component at the potentiometer 266, are employed together with and compliment the improved and simplified separated bands of servo equalization shown in FIG. 9.

Although FIG. 9 shows but two frequency bands of servo equalization, a low pass band and a high pass band, it will be readily appreciated that additional bands may be employed. Thus each of the illustrated bands, the low pass band and the high pass band, may itself be divided into two or more separate low or high pass bands, each having the identical servoing components, as illustrated in FIG. 9. Thus, for example, if the low pass band were to be divided into two different low pass bands, the servoed equalization would provide two of each of the elements in the low frequency channel, two filters 450, two amplifiers 452, and two of each of the other components shown in FIG. 9 for the low pass band, with all the channels summed, as will be apparent to those skilled in the art.

Improved enhancement by means of separate bands of servoed equalization has been described in connection with a system employing fixed sum and difference equalizers, as shown in FIG. 5. The system illustrated in FIG. 1 employs both dynamic sum and difference signal equalizers 21 and 19, and also a fixed difference signal equalizer 18. Where the servoed equalization arrangement is to be used with a system such as shown in FIG. 1, the dynamic sum and difference equalizer would still be used, but the system of FIG. 9 would be employed to replace the circuits including fixed difference signal equalizer 18, gain controlled amplifier 22, and control circuit 30, with the inputs to the directivity servos as described in connection with FIGS. 9 and 3.

The separate high pass and low pass servoed equalization bands of FIG. 9, as described above, are advantageously employed with a system using the directivity servo of FIGS. 3 and 4, particularly because the circuit of FIG. 4 provides a necessary component for use with the processing arrangement of FIG. 9. Such necessary component is the dynamically enhanced sum signal component on potentiometer 266 of FIG. 4, as previously described.

Figure 10:
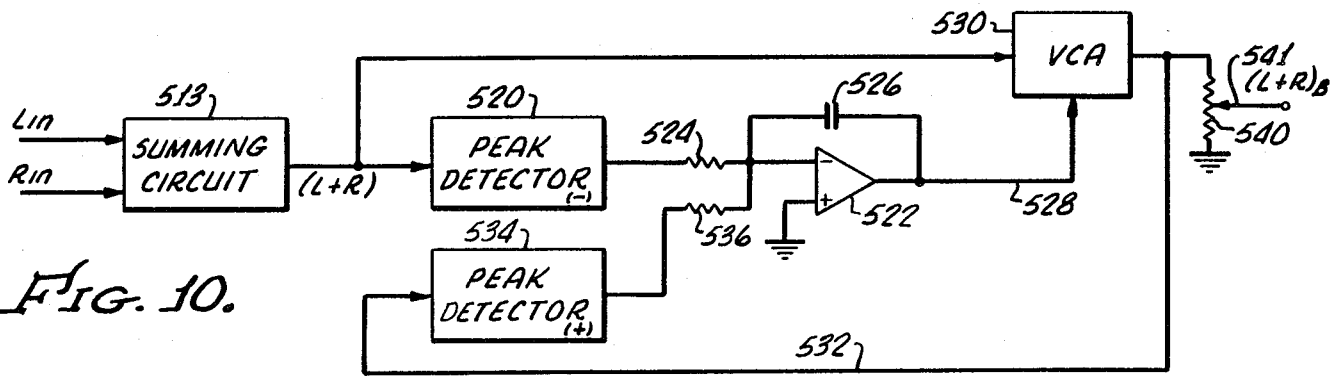
FIG. 10 shows an arrangement for dynamically boosting sum signal where multiple band servoed equalizers are employed without directivity servos.

The separate band servoed equalizer arrangement of FIG. 9, however, need not be employed with the directivity servo, but may also be employed in a system having no directivity servos at all. In such a situation, circuitry must be provided to separately generate a dynamically enhanced or dynamically boosted sum signal component for combination with the dynamically boosted high and low pass bands of the servoed equalizers. A circuit for providing such dynamic boosting of the sum signal component, where no directivity servo is employed, is illustrated in FIG. 10, showing a summing circuit 513 receiving left and right stereo input signals and providing a sum signal output (L+R). The sum signal is fed to an inverting peak detector 520, providing the amplitude envelope of the sum signal, and thence to the inverting input of a summing amplifier 522 via a first summing resistor 524. Amplifier 522 has a capacitor 526 in a feedback path between its output and its inverting input to provide for integration of the input. The output of amplifier 522 provides a dynamic control signal on a line 528 which is fed to control the gain of a voltage controlled amplifier 530, which receives as its input the sum signal (L+R) from summing circuit 513. Like the other VCA's described herein, amplifier 530 has a minimum gain of unity. Feedback from the gain adjusted sum signal at the output of amplifier 530 is provided on a line 532 to the input of a non-inverting peak detector 534 at the output of which is provided a DC signal representing the amplitude envelope of the dynamically adjusted sum signal. This envelope is fed to a second resistor 536 of the resistive summing network at the inverting input of amplifier 522, with polarity opposite the polarity of the signal fed to resistor 524, as is the case with the other summing amplifiers, such as amplifiers 458 and 482 of FIG. 9. Preferably resistors 536 and 524 have a ratio of resistances of approximately two to one (the resistance of resistor 536 is approximately twice that of resistor 524).

With the arrangement illustrated in FIG. 10, an increase in the signal (L+R) is sensed by the illustrated circuit and effectively amplified so that a greater increase appears in the output of the voltage controlled amplifier. The circuit of FIG. 10 effectively causes the output of the VCA to increase exponentially with respect to increases of the (L+R) input to the peak detector 520, but the output of the VCA never is less than the input to peak detector 520. Such output is fed to an amplitude adjusting potentiometer 540, from the output of which, on line 541, appears the dynamically boosted sum signal component $(L+R)_b$ which will be fed to the mixer together with the servoed and equalized difference signal $(L-R)_p$ at the output of summing amplifier 471 of FIG. 9. Thus if the system of FIG. 9 is to be employed without use of the directivity servos of FIGS. 3 and 4, a supplementary, dynamically boosted sum signal otherwise provided by potentiometer 266 of the directivity servo circuit of FIG. 4 would be provided instead by the dynamically boosted sum signal circuit of FIG. 10.

Where the system of FIG. 9 is employed without the directivity servo, the servoed and equalized difference signal component $(L-R)_p$ is split and fed through an inverter to provide (L−R) and (R−L) components. The processed difference signal components $(L-R)_p$ an $(R-L)_p$ and the dynamically boosted sum signal $(L+R)_b$ from line 541 of FIG. 10 are fed to the mixer as shown in FIG. 11. The processed difference signal $(L-R)_p$ from summing amplifier 420 of FIG. 7 is combined with the dynamically boosted sum signal $(L+R)_b$ in a summing amplifier 550, the output of which is fed to a width adjusting potentiometer 552. The opposite phase processed difference signal $(R-L)_p$ is combined with the boosted sum signal $(L+R)_b$ in a summing amplifier 554, of which the output is fed to a second width adjusting potentiometer 556. Signals taken from the ganged wiper arms of the potentiometers 552,556 are fed to and combined in mixer 560 with the input signals $L_{in}$ and $R_{in}$ to provide the mixer output signal $L_{out}$ and $R_{out}$.

It will be seen from the above description that in addition to the servoed equalization by separate bands of the difference signal, the sum signal is dynamically boosted. That is, any increase in the sum signal is magnified by the directivity servo operation or by the operation of the dynamic boost circuit of FIG. 10. In addition, the amount of increased sum signal component is directly controlled (together with processed difference signals) in accordance with the setting of the width control potentiometers, since the sum signal is fed through the ganged width adjusting potentiometers 552,556 of FIG. 11 or 223*a*,223*b* of FIG. 4. It will be understood that other types of ganged attenuating circuits, such as ganged voltage controlled attenuators, may be employed instead of the various ganged potentiometers described herein.

A major and unexpected benefit of the use of the multi-channel servoed equalizer arrangement (which was introduced in order to eliminate the reverberation filter) is that it also provides for independent control of upper or lower frequency bands of the difference signal. It will be recalled that the prior system maintains a fixed ratio between processed difference signal and sum signal. Therefore, for example, should the sum signal increase in amplitude only in the lower frequency band, the system of my prior patent would provide a boost of the difference signal across the entire frequency band handled by the system. Similarly an increase in upper frequency components of the sum signal would cause a boost of the difference signal across the entire band of the prior system. With the multi-channel arrangement illustrated in FIG. 7, an increase in sum signal that occurs only in a lower frequency band, for example, causes a concomitant boost in the difference signal only in the corresponding lower band. Thus the desired fixed ratio between the difference and sum signal is more precisely maintained, band by band. In other words, if necessary the circuit described herein will maintain the desired fixed ratio between the processed difference signal and the sum signal solely in the upper band or solely in the lower band, if necessary, without improperly disturbing the desired ratio in the other of these two bands.

Still another advantage of the multi-channel servoed equalizer system is that it eliminates the need to correct for phase shift that may be introduced by the reverberation filter of the prior system.

Thus it will be seen that the arrangement provides for two separate and independent amplitude control or attenuating potentiometers for the sum signal components that are fed through the directivity servos. The first of these attenuating controls is provided by potentiometer 202 of FIG. 3, and the second of these independent controls is provided by potentiometer 266 of FIG. 4. This attenuation of the sum signal component in a system using the directivity servos helps to prevent the sum signal from dominating the operation of the directivity servo. Such domination is to be avoided because the primary function of the directivity servo is to enhance difference signal components.

The arrangement illustrated in FIGS. 3 and 4 for mixing a portion of the sum signal with the difference signal before sending the combined signal through the directivity servos helps to overcome the problem of apparent fading of center stage sound sources, such as a soloist, when using the directivity servos. It will be recalled that the arrangement of FIGS. 3 and 4 provides an additional dynamically enhanced sum signal portion, at the output of potentiometer 266, which is combined with the directivity enhanced left and right difference signals and the left and right input signals in the mixers 240,242. FIG. 12 illustrates an alternative embodiment for providing this dynamically enhanced sum signal portion to prevent apparent fading of center stage signals, employing a simplified circuit containing a center voltage controlled amplifier. The circuit of FIG. 12 is arranged particularly to be used with the multi-band servoed equalizer arrangement of FIG. 9, and, moreover, includes substantially all the same components of FIG. 2. Elements of FIG. 12, which are the same as elements of FIG. 2, are designated the same reference numerals, prefaced by the numeral 5, so that peak detector 560 of FIG. 12 corresponds to peak detector 60 of FIG. 2, voltage controlled amplifier 580 of FIG. 12 corresponds to voltage controlled amplifier 80 of FIG. 2, and peak detector 660, amplifier 666 and voltage controlled amplifier 680 of FIG. 12 correspond respectively to peak detector 160, amplifier 166 and voltage controlled amplifier 180 of FIG. 2. In some instances components in FIG. 12 are prefaced by the numeral 6 (instead of 5), depending upon whether the reference numbers of FIG. 2 are below or above 100. For example, amplifier 680 of FIG. 12 corresponds to amplifier 180 of FIG. 2. In addition to the identical components of FIG. 2 (duplicated in FIG. 12), FIG. 12 also includes a gain adjusting circuit 590, a center voltage controlled amplifier 592, an averaging circuit 594, and the conventional mixers 596,598.

The modified directivity servos shown in FIG. 12 receive the signal $(L-R)_p$ from summing amplifier 471 of FIG. 9 and feed these signals to voltage controlled amplifiers 580 and 680 directly and via an inverter 542. The inputs and outputs of the voltage controlled amplifiers are compared in difference circuits 582 and 682, respectively, to provide feedback signals to non-inverting peak detectors 572 and 672 respectively. Outputs of the peak detectors are compared with outputs of peak detectors 560 and 660, respectively receiving the input signals $L_{in}$ and $R_{in}$. This provides the controlled ratio inputs to amplifiers 566 and 666, via the input resistive network 562,570 for amplifier 566, and resistive network 662,670 for the inputs of amplifier 666. The ratios of the amplifier input resistors are the same as described for the corresponding input resistors of FIG. 2. Outputs of the amplifiers 566 and 666 are provided as control signals to the voltage controlled amplifiers 580 and 680 respectively of the left and right directivity servos. These two control signals at the outputs of amplifiers 566 and 666 are added and divided by two in an averaging circuit 594 to provide a control signal for the center or sum signal voltage controlled amplifier 592, which receives an input from a gain adjusting circuit 590 that provides a selected fixed adjustment of gain of the sum signal $(L+R)$ obtained from summing circuit 413 of FIG. 9. The output of center voltage controlled amplifier 592 thus ~~is a~~ dynamically enhanced version of the sum signal, identified in FIG. 12 as $K(L+R)$, which is fed to a width adjusting potentiometer 523, having its wiper arm ganged with wiper arms of the width adjusting potentiometers **523*a* and 523*b*, which respectively receive the outputs of voltage controlled amplifiers 580,680 for left and right channel processed and enhanced signals. The several signals are combined in the left and right mixers 596,598, with the former combining the left channel input $L_{in}$, the left directivity processed and enhanced difference signal $(L-R)_{pe}$, and the dynamically enhanced sum signal $K(L+R)$. The right mixer 598 combines the right channel input $R_{in}$, the right channel processed and enhanced directivity signal $(R-L)_{pe}$, and the dynamically enhanced sum signal from potentiometer 523** $K(L+R)$, to provide the output signals $L_{out}$, $R_{out}$ respectively.

It will be seen then that the arrangement of FIG. 12 is functionally equivalent to the arrangement of FIGS. 3 and 4, in that a portion of the sum signal is combined with the directivity servoed left and right channel signals to avoid the appearance of fading of center stage sounds. The added sum signal is adjusted in amplitude in potentiometer 523, together with any adjustment of potentiometers **523*a* and 523*b*** of the left and right channels respectively, so as to simultaneously adjust all three components of left and right channel signals for adjustment of stereo image width.

Mixer outputs of FIGS. 1, 4, 11 and 12 may be fed to a sound recording device, instead of the speakers, where the system is used to make a recording. The present systems may be used to make recordings bearing the enhanced signals for playback on conventional playback systems, just as described in my prior U.S. Pat. No. 4,748,669. The resultant recordings, when played back on a conventional playback device, produce left and right stereo output signals that are modifications of the input left and right signals having the various enhanced components as described above.

Although the described analog implementations are presently preferred, digital implementations are also contemplated. For example, the system shown in FIG. 7 can be built using digital techniques for all or most circuits, or using analog circuits for all sound signals and digital techniques for control circuits.

The peak detectors described as used in various circuits described above are but one of several known types of envelope detectors. It will be understood that other types of envelope detectors may be employed herein.

What is claimed is:

1. A stereo image enhancement system comprising:

means for providing sum and difference signals representing respectively the sum of and difference between left and right stereo input signals, means for processing the sum and difference signals to provide processed sum and difference signals, servo means responsive to change in amplitude of one of said input signals and to said processed difference signal for varying amplitude of said processed difference signal to provide a directivity enhanced difference signal having an amplitude that varies with variation of said one input signal, and means responsive to said processed sum signal and said enhanced difference signal for providing left and right stereo output signals.

2. The system of claim 1 wherein said servo means includes means responsive to an amplitude increase of a first magnitude of said input signal for increasing amplitude of said processed difference signal by a second magnitude that is considerably greater than said first magnitude.

3. The system of claim 2 wherein said second magnitude is between about two to three times greater than said first magnitude.

4. The system of claim 1 wherein said servo means includes means responsive to said directivity enhanced difference signal and to said one input signal for controlling amplitude of said directivity enhanced signal.

5. The system of claim 1 wherein said servo means comprises means for generating a feedback signal indicative of amplitude variation of said processed difference signal, and control means responsive to said one input signal and to said feedback signal for controlling variation of said processed difference signal to provide said directivity enhanced difference signal.

6. The system of claim 1 wherein said servo means comprises means for providing a feedback signal indicative of the difference between the directivity enhanced signal and said processed difference signal, means for generating a control signal that is a function of the feedback signal and said one input signal, and control means responsive to said control signal for varying amplitude of said difference signal.

7. The system of claim 1 wherein said servo means comprises an amplitude control circuit having said processed difference signal as an input thereto and having having said directivity enhanced signal as an output, means for providing a feedback signal in accordance with the difference between said processed difference signal and said directivity enhanced signal, means responsive to said feedback signal and to said one input signal for providing a control signal indicative of a predetermined relation between said feedback signal and said one input signal, and means for feeding said control signal to said amplitude control circuit to control amplitude of said directivity enhanced signal.

8. The system of claim 1 wherein said servo means comprises a voltage controlled amplifier, means for feeding said processed difference signal to said voltage controlled amplifier, said voltage controlled amplifier providing said directivity enhanced signal as an output thereof, a difference circuit having said processed difference signal and said directivity enhanced signal provided as inputs thereto and providing a feedback signal, an integrating amplifier having an input and having a control signal output, a resistive summing network connected to said integrating amplifier input and having first and second input resistors, means for feeding said one input signal to said first input resistor, and means for feeding said feedback signal to said second input resistor.

9. The system of claim 8 wherein the magnitude of said second input resistor is in the range of about two to three times the magnitude of said first input resistor.

10. The system of claim 8 including means for combining a portion of said processed sum signal with said processed difference signal to provide a combined signal, and wherein said means for feeding said processed difference signal to said voltage controlled amplifier includes means for feeding said combined signal to said voltage controlled amplifier, and wherein said difference circuit has said combined signal and said directivity enhanced signals provided as inputs thereto.

11. The system of claim 1 wherein said means for providing processed sum and difference signals comprises means for providing left and right processed difference signals of mutually opposite phase, and wherein said servo means comprises left servo means responsive to change in amplitude of said left input signal and to a directivity enhanced left signal for varying amplitude of said left processed difference signal to provide a directivity enhanced left signal, and right servo means responsive to change in amplitude of said right input signal and to a directivity enhanced right signal for varying amplitude of said right processed difference signal to provide said directivity enhanced right signal.

12. The system of claim 11 wherein each said left and right servo means comprises an amplifier having a control input, having one of said left and right processed difference signals as a signal input and providing an associated one of said directivity enhanced left and right signals as an output, means for generating a feedback signal indicative of the difference between the signal input and the output of the amplifier, means for comparing the feedback signal with one of the stereo input signals to provide a control signal, and means for feeding the control signal to the control input of the amplifier.

13. The system of claim 1 wherein said servo means comprises an amplitude control circuit having an input, means for combining with said processed difference signal a portion of said processed sum signal to provide a combined signal, and means for feeding the combined signal to the amplitude control circuit input.

14. A stereo image enhancement system comprising:

means for providing sum and difference signals representing respectively the sum and difference between left and right stereo input signals, difference signal equalizing means responsive to said difference signal for providing a first processed difference signal having frequency components in quieter difference frequency bands that are relatively boosted with respect to components in other frequency bands, sum signal equalizing means responsive to said sum signal for modifying amplitude of components of said sum signal in said quieter frequency bands to provide a processed sum signal, means responsive to said first processed difference signal for providing an inverted processed difference signal, left direction enhancement means responsive to amplitude increases of said left stereo input signal and to said first processed difference signal for increasing amplitude of said first processed difference signal to provide an enhanced left processed difference signal having amplitude increase that are greater than corresponding amplitude increases of said left stereo input signal, right direction enhancement means responsive to amplitude increases of said right input stereo signal and to said inverted processed difference signal for increasing amplitude of said inverted processed difference signal to provide an enhanced right processed difference signal having amplitude increases that are greater than corresponding amplitude increases of said right input stereo signal, and means for combining said enhanced right and left processed difference signals and said processed sum signal to provide left and right stereo output signals.

15. The system of claim 14 including means for simultaneously disabling both of said direction enhancement means, said means for combining including means for combining said processed sum signal and said processed difference signal with said inverted processed difference signal to provide said stereo outputs.

16. The system of claim 14 wherein said left direction enhancement means comprises servo means responsive to said left stereo input signal and to said first processed difference signal for varying amplitude of said first processed difference signal so as to obtain said enhanced left processed difference signal.

17. The system of claim 14 wherein said right direction enhancement means comprises servo means responsive to said right stereo input signal and to said inverted processed difference signal for varying amplitude of said inverted processed difference signal so as to obtain said enhanced right processed difference signal.

18. For use in a stereo enhancement system wherein sum and difference signals that represent sum of and difference between left and right stereo input signals are processed to provide a processed sum signal and left and right processed difference signals, and wherein the processed signals are combined to provide left and right stereo output signals, said output signals being fed to a speaker system to produce stereo sound, a method of increasing apparent directivity of sound produced by said speaker system, said method comprising the steps of:

enhancing said left processed difference signal by varying its amplitude in accordance with variation of amplitude of said left input signal, thereby providing a directivity enhanced left signal, and enhancing said right processed difference signal by varying its amplitude in accordance with variation of amplitude of said right input signal, thereby providing a directivity enhanced right signal.

19. The method of claim 18 wherein said step of varying amplitude of said left processed difference signal comprises increasing amplitude of said left processed signal by a first magnitude in response to an increase of amplitude of said left stereo input signal of a second magnitude, where the ratio of said first magnitude to said second magnitude is between about two to one and three to one.

20. The method of claim 18 wherein said step of enhancing said left processed signal comprises applying the left processed signal to a gain controlled amplifier, and varying the gain of said amplifier in accordance with amplitudes of said left stereo signal and said directivity enhanced left signal

21. The method of claim 18 wherein said step of enhancing said left processed difference signal comprises amplifying said left processed difference signal in response to a control signal, generating a feedback signal indicative of change in amplitude of the left processed difference signal, and comparing the feedback signal with the left input signal to generate said control signal.

22. The method of claim 18 wherein said step of enhancing said left processed difference signal comprises the steps of combining said left processed difference signal with a portion of said left processed sum signal to provide a combined signal, and enhancing said combined signal by varying its amplitude in accordance with variation of amplitude of said left input signal

23. The method of claim 21 wherein said step of generating a feedback signal includes comparing said directivity enhanced left signal with said left processed difference signal before amplification of said left processed difference signal.

24. The method of claim 21 wherein said step of comparing comprises combining said feedback and left input signals to produce a combined signal and integrating said combined signal to generate said control signal.

25. The method of claim 21 including the step of combining said feedback and left input signals with an amplitude ratio of feedback signal to left input signal in the range of between two to one and three to one.

26. The method of claim 21 wherein said step of enhancing said right processed difference signal comprises amplifying said right processed difference signal in response to a second control signal, generating a second feedback signal indicative of change in amplitude of the right processed difference signal, and comparing the second feedback signal with the right input signal to generate said second control signal.

27. The method of claim 26 wherein said step of generating a second feedback signal includes comparing said directivity enhanced right signal with said right processed difference signal before amplification of said right processed difference signal

28. The method of claim 26 wherein said step of comparing comprises combining said second feedback and right input signals to produce a combined signal and integrating said combined signal to generate said second control signal.

29. The method of claim 28 wherein said second feedback and right input signals are combined with an amplitude ratio of said second feedback signal to right input signal in the range of between about two to one and three to one.

30. A stereo image enhancement system comprising:

means for providing sum and difference signals that respectively represent sum of and difference between left and right stereo input signals, means for processing the sum and difference signals to provide a processed sum signal and left and right processed difference signals, means for combining the sum and difference signals to provide left and right stereo output signals, and servo means for increasing directivity of sound produced in response to said left and right stereo output signals, said servo means comprising:

left servo means for increasing amplitude of said left processed difference signal in accordance with amplitude increase of said left stereo input signal to provide a directivity enhanced left signal having an amplitude increase that is greater than said amplitude increase of said left stereo input signal, and right servo means for increasing amplitude of said right processed difference signal in accordance with amplitude increase of said right input stereo signal to provide a directivity enhanced right signal having an amplitude increase that is greater than said amplitude increase of said right stereo input signal.

31. The system of claim 30 wherein said left servo means comprises means for amplifying said left processed difference signal in response to a control signal, means for generating a feedback signal indicative of said directivity enhanced left signal, and means for comparing the feedback signal with the left input signal to generate said control signal.

32. The system of claim 31 wherein said means for amplifying said left processed difference signal comprises means for adding a portion of said processed sum signal to said left processed difference signal to provide a combined signal, and means for amplifying said combined signal in response to said control signal.

33. The system of claim 31 wherein said means for generating a feedback signal includes means for comparing said directivity enhanced left signal with said left processed difference signal before amplification.

34. The system of claim 31 wherein said means for comparing comprises combining said feedback and left input signals to produce a servo error signal, and means for generating said control signal in response to said error signal.

35. The system of claim 34 wherein said means for generating said control signal comprises means for integrating said error signal.

36. The system of claim 34 wherein said means for combining said feedback and left input signals includes means for maintaining the amplitude of said feedback signal at a value considerably greater than the amplitude of said left input signal.

37. The system of claim 34 wherein said means for combining said signals to produce said servo error signal include means for causing the ratio of amplitude of said feedback signal to amplitude of said input signal to be between about two to one and three to one.

38. The system of claim 30 wherein said means for processing said sum and difference signals comprise means for providing said left processed difference signal and inverter means responsive to said left processed difference signal for providing a second processed difference signal.

39. The system of claim 30 wherein said means for processing comprises means for equalizing said difference signal so as to boost frequency components thereof in quieter frequency bands of said difference signal, and means for equalizing said sum signal to relatively attenuate components thereof in said quieter frequency bands of said difference signal.

40. The system of claim 32 wherein said means for amplifying said combined signal comprises means for providing an amplified and enhanced signal having sum and difference components, and means for separately and independently controlling relative amplitudes of said sum and difference components.

41. A stereo image enhancement system comprising:

means for providing sum and difference signals representing respectively the sum of and difference between left and right stereo input signals, means for processing the sum and difference signals to provide processed sum and difference signals, means for combining portions of said processed sum and difference signals to provide a combined signal, servo means responsive to change in amplitude of one of said input signals and to said processed difference signal for varying amplitude of said combined signal to provide a directivity enhanced combined signal having an amplitude that varies with variation of said one input signal, said directivity enhanced combined signal including directivity enhanced sum and difference signal components, means for controlling relative amplitudes of said directivity enhanced sum and difference components, and means responsive to said directivity enhanced sum and difference components for providing left and right stereo output signals.

42. A stereo image enhancement system comprising:

means for providing sum and difference signals representing respectively the sum of and difference between left and right stereo input signals, first means for boosting amplitudes of components of said difference signal in a band of higher frequencies higher than a mid-range band of frequencies relative to amplitudes of components of said sum signal in a corresponding band of higher frequencies, second means for boosting amplitudes of components of said difference signal in a band of lower frequencies lower than said mid-range band of frequencies relative to amplitudes of components of said sum signal in a corresponding band of low frequencies, and means responsive to said boosted components of said difference signal and to said sum signal for providing right and left stereo output signals.

43. The system of claim 42 including means for separating said difference signal into high and low frequency band components to enable independent boosting of amplitudes in said higher and lower frequency bands.

44. The system of claim 42 wherein said first and second means for boosting are mutually independent.

45. The system of claim 42 wherein said higher and lower frequency bands are separated from each other by said mid-range band of frequencies, and wherein said responsive means includes means for combining with said boosted components a component of said difference signal in said midrange band of frequencies.

46. The system of claim 42 wherein said second means comprises a first low pass frequency filter responsive to the difference signal for providing a low frequency difference signal component, a second low pass frequency filter responsive to the sum signal for providing a low frequency sum signal component, and means for maintaining a predetermined ratio of amplitudes of said low frequency difference signal component and said low frequency sum signal component.

47. The system of claim 46 wherein said means for maintaining a predetermined ratio comprises means for maintaining amplitude of said low frequency difference signal component at a value not less than the value of the amplitude of said low frequency sum signal component.

48. The system of claim 46 wherein said predetermined ratio is in the range of between one to one and three to one.

49. The system of claim 46 wherein said means for maintaining a predetermined ratio comprises a voltage controlled amplifier responsive to said low frequency component of said difference signal for providing a boosted low frequency difference signal component, means responsive to said low frequency component of said difference signal and to said low frequency component of said sum signal for generating a control signal, and means for controlling gain of said voltage controlled amplifier in accordance with said control signal

50. The system of claim 49 wherein said means for generating a control signal comprises an operational amplifier having said control signal as an output and having a first input, and means for feeding to said first input a signal representing a predetermined ratio of amplitude of said low frequency difference signal component to amplitude of said low frequency sum signal component.

51. The system of claim 42 wherein said first means for boosting amplitude of components of said difference signal comprises a first high pass frequency filter responsive to said difference signal for providing a high frequency difference signal component, a second high pass frequency filter responsive to said sum signal for providing a high frequency sum signal component, a high frequency voltage controlled amplifier having said high frequency difference signal component as an input thereto and providing as its output a boosted high frequency difference signal component, means responsive to said boosted high frequency difference signal component and to said high frequency sum signal component for generating a control signal, and means for controlling gain of said high frequency voltage controlled amplifier in response to said control signal.

52. The system of claim 42 including means responsive to said difference signal for disabling said first means and said second means when the magnitude of said difference signal is less than a predetermined amount.

53. The system of claim 42 wherein said first means provides a high frequency boosted difference signal component, wherein said second means provides a low frequency boosted difference signal component, and including means for combining said high and low frequency boosted difference signal components with said difference signal to generate a processed difference signal.

54. The system of claim 53 including servo means responsive to change in amplitude of one of said input signals and to said processed difference signal for varying amplitude of said processed difference signal to provide a directivity enhanced difference signal having an amplitude that varies with variation of said one input signal, and means for combining said directivity enhanced difference signal, said sum signal, and said input signals to provide left and right stereo output signals.

55. A stereo image enhancement system comprising:

means for providing sum and difference signals representing respectively the sum of and difference between left and right stereo input signals, low pass servoed equalizer means responsive to the sum and difference signals for providing a low processed difference signal component in a band of relatively low frequencies and having an amplitude boosted relative to amplitude of a component of the sum signal in a corresponding band of relatively low frequencies, high pass servoed equalizer means responsive to said sum and difference signals for providing a high processed difference signal component in a band of relatively high frequencies and having an amplitude boosted relative to the amplitude of a component of the sum signal in a corresponding band of relatively high frequencies, means for combining said difference signal with said low processed difference signal component and said high processed difference signal component to provide a composite processed difference signal, means for generating a dynamically enhanced sum signal, and means for combining said composite band processed difference signal, said dynamically enhanced sum signal, and said input signals for providing left and right enhanced stereo output signals.

56. The system of claim 55 wherein said means for generating a dynamically enhanced sum signal comprises a voltage controlled amplifier having a first input from said sum signal and having an output which provides said dynamically enhanced sum signal, means for generating a control signal representing a predetermined ratio of amplitudes of said dynamically controlled sum signal and said sum signal, and means responsive to said control signal for controlling gain of said voltage controlled amplifier.

57. The system of claim 55 wherein said means for generating a dynamically enhanced sum signal includes means for combining portions of said composite processed difference signal and said sum signal to provide a combined signal, servo means responsive to change in amplitude of one of said input signals and to said combined signal for varying amplitude of said combined signal having an amplitude that varies with variation of said one input signal, said combined signal including directivity enhanced sum and difference signal components, and means for separating said directivity enhanced sum signal component from said directivity enhanced difference signal component of said combined signal to provide said dynamically enhanced sum signal.

58. The system of claim 55 wherein said means for generating a dynamically enhanced sum signal comprises a center voltage controlled amplifier having an input from said sum signal and having an output which provides said dynamically enhanced sum signal, means for generating left and right control signals, means for combining said left and right control signals to provide a combined control signal, and means responsive to said combined control signal for controlling gain of said center voltage controlled amplifier

59. For use in a stereo enhancement system wherein sum and difference signals that represent sum of and difference between left and right stereo input signals are processed to provide a processed sum signal and left and right processed difference signals, and wherein the processed signals are combined to provide left and right stereo output signals, said output signals being fed to a speaker system to produce stereo sound, a method of enhancing the stereo output signals comprising the steps of:

boosting amplitude of components of said difference signal in a band of higher frequencies higher than a center band of frequencies relative to amplitude of components of said sum signal in a corresponding band of higher frequencies, boosting amplitude of components of said difference signal in a band of lower frequencies lower than said center band of frequencies relative to amplitude of components of said sum signal in a corresponding band of lower frequencies, and employing said sum signal and said boosted components of said difference signal for providing right and left stereo enhanced output signals.

60. The method of claim 59 including the step of separating said difference signal into high and low frequency band components.

61. The method of claim 59 wherein said step of boosting amplitude of components of the difference signal in a band of higher frequencies is carried out independently of said step of boosting amplitude of components of said difference signal in a band of lower frequencies.

62. The method of claim 59 including the step of combining with said boosted higher frequency and boosted lower frequency components of the difference signal a signal representing said difference signal components over a center band of frequencies to produce a broad band processed difference signal, said center band including frequencies between said bands of higher and lower frequencies.

63. The method of claim 62 wherein said step of employing said boosted components for providing right and left stereo enhanced output signals comprises the step of providing a dynamically enhanced sum signal and combining said enhanced sum signal with the boosted components of said difference signal.

64. The method of claim 63 including the step of combining portions of said broad band processed difference signal with said sum signal to provide a combined processed signal, varying amplitude of said combined processed signal in response to change in amplitude of one of said input signals to provide a directivity enhanced combined signal having an amplitude that varies with variation of said one input signal, said directivity enhanced combined signal including directivity enhanced sum and difference signal components, separating said directivity enhanced sum signal component from the directivity enhanced difference signal component, and employing a portion of said directivity enhanced sum signal component as said dynamically enhanced sum signal.

65. An enhanced image stereo sound recording for use in a sound recording playback system, said sound recording comprising:

a record medium embodying signal producing means adapted to operate with a sound recording responsive device to produce left and right stereo output signals that are modifications of left and right stereo source signals, said stereo output signals each comprising a combination of signal components including:

(1) a processed high frequency difference signal component which comprises a modification of a band of high frequencies higher than a center band of frequencies of an input difference signal representing the difference of said left and right stereo source signals, (2) a processed low frequency input difference signal component which comprises a modification of a band of low frequencies lower than said center band of frequencies of an input difference signal representing the difference of said left and right stereo source signals, (3) a dynamically enhanced sum signal component which comprises a modification of an input sum signal representing the sum of said left and right stereo source signals, said processed high and low difference signal components being boosted relative to input sum signal components in corresponding frequency bands.

66. The sound recording of claim 65 wherein said processed high frequency difference signal component and a sum signal component in a corresponding band of high frequencies have a predetermined relation of magnitudes that is substantially constant, and wherein said processed low frequency difference signal component and said input sum signal component in a corresponding band of high frequencies have a predetermined relation of magnitudes that is substantially constant.

67. The sound recording of claim 65 wherein said high frequency difference signal component has an amplitude that varies in accordance with one of said input sum and difference signals to continually adjust the amount of boosting of said difference signal component automatically according to the amount of stereo information present in said stereo source signals.

68. The sound recording of claim 65 wherein at least one of said processed high and low frequency difference signal components has a magnitude relative to the magnitude of the input sum signal in a corresponding band of frequencies that is in the range of between one to one and three to one.

69. A method for making a stereo sound recording from left and right stereo source signals comprising the steps of:

providing sum and difference signals representing sum of and difference between left and right stereo source signals, separately boosting components of said difference signal in a band of low frequencies lower than a center band of frequencies with respect to components of said sum signal in a corresponding band of low frequencies, separately boosting components of said difference signal in a band of high frequencies higher than said center band of frequencies with respect to components of said sum signal in a corresponding band of high frequencies, combining said boosted high frequency and boosted low frequency difference signal components with the difference signal, said difference signal having frequencies between said low and high frequency band, to thereby provide a processed difference signal, combining the sum signal with said processed difference signal to provide stereo enhanced left and right output signals, feeding the stereo enhanced left and right output signals to a sound recording device, and operating said sound recording device to make a sound recording.

70. The method of claim 69 including the step of enhancing said processed difference signal by varying its amplitude in accordance with variation of amplitude of said left input signal, thereby providing a directivity enhanced left signal, and combining said directivity enhanced left signal with said processed sum signal to provide said stereo enhanced left and right output signals.

71. A method for producing an enhanced stereo sound image comprising the steps of:

providing sum and difference signals representing sum of and difference between left and right stereo source signals, separately boosting components of said difference signal in a band of low frequencies with respect to components of said sum signal in a corresponding band of low frequencies, separately boosting components of said difference signal in a band of high frequencies higher than said center band of frequencies with respect to components of said sum signal in a corresponding band of high frequencies, combining said boosted high frequency and boosted low frequency difference signal components with components of said difference signal in at least a band of frequencies between said band of low frequencies and said band of high frequencies, to thereby provide a processed wide band difference signal having upper and lower frequency components thereof boosted, and combining said sum signal with said processed wide band difference signal to provide stereo enhanced left and right output signals.

72. The method of claim 71 wherein said step of separately boosting components of said difference signal in a band of low frequencies comprises the step of maintaining a predetermined ratio of amplitudes of components of said difference signal in said band of low frequencies with respect to amplitudes of components of said sum signal in said corresponding band of low frequencies, and wherein said step of separately boosting components of said difference signal in a band of high frequencies comprises maintaining a predetermined ratio of amplitudes of components of said difference signal in said band of high frequencies with respect to amplitudes of components of said sum signal in said corresponding band of high frequencies.

* * * * *

UNITED STATES PATENT AND TRADEMARK OFFICE

CERTIFICATE OF CORRECTION

PATENT NO. : 4,866,774

DATED : September 12, 1989

INVENTOR(S) : Arnold I. Klayman

It is certified that error appears in the above—identified patent and that said Letters Patent is hereby corrected as shown below:

In the title, "STERO" should read --STEREO--.

Column 2, line 22, "stere" should read --stereo--.

Column 2, line 23, "and input" should read --an input--.

Column 24, line 25, "increase" should read --increases--.

Column 27, line 55, "low" should read --lower--.

Column 29, line 36, delete "band".

Column 29, line 57, after "signal" insert --to provide a directivity enhanced broad band combined signal--.

Column 32, line 31, after "frequencies" insert --lower than a center band of frequencies--.

Signed and Sealed this

Second Day of April, 1991

*Attest:*

*Attesting Officer*

HARRY F. MANBECK, JR.

*Commissioner of Patents and Trademarks*